US009073666B2

(12) United States Patent
Petlak et al.

(10) Patent No.: US 9,073,666 B2
(45) Date of Patent: Jul. 7, 2015

(54) CONTAINER WITH STACKING FEATURE

(75) Inventors: Frank Andrew Petlak, Antioch, IL (US); H. Bernard Kirkland, Lindenhurst, IL (US); Craig Edward Cappel, Lake Villa, IL (US)

(73) Assignee: PACTIV LLC, Lake Forest, IL (US)

( * ) Notice: Subject to any disclaimer, the term of this patent is extended or adjusted under 35 U.S.C. 154(b) by 1405 days.

(21) Appl. No.: 12/536,971

(22) Filed: Aug. 6, 2009

(65) Prior Publication Data

US 2011/0031152 A1 Feb. 10, 2011

(51) Int. Cl.
*B65D 21/00* (2006.01)
*B65D 21/04* (2006.01)
*B65D 1/34* (2006.01)

(52) U.S. Cl.
CPC ..... *B65D 21/043* (2013.01); *B65D 1/34* (2013.01)

(58) Field of Classification Search
CPC ..... B65D 21/0224; B65D 71/70; B65D 2501/24108; B65D 1/243; B65D 21/0209
USPC ..... 206/503–509, 541; 220/1.5, 212, 23.8, 220/23.83, 254.1, 254.8, 276, 281, 376, 220/507; 222/109, 567, 568, 465.1, 556
See application file for complete search history.

(56) References Cited

U.S. PATENT DOCUMENTS

| | | | | | |
|---|---|---|---|---|---|
| 2,813,656 | A * | 11/1957 | Anderson | 206/507 |
| 2,823,829 | A * | 2/1958 | Frater | 206/507 |
| 3,409,123 | A * | 11/1968 | McCormick | 206/216 |
| 3,759,416 | A * | 9/1973 | Constantine | 206/505 |
| 5,896,993 | A * | 4/1999 | Nask et al. | 206/508 |
| D411,709 | S | 6/1999 | Curtis et al. | |
| D418,415 | S | 1/2000 | Hayes et al. | |
| 6,095,333 | A * | 8/2000 | Bertrand | 206/505 |
| D461,123 | S | 8/2002 | Hayes et al. | |
| 6,619,501 | B2 | 9/2003 | Hayes et al. | |
| 7,228,986 | B2 | 6/2007 | Hayes et al. | |
| D625,139 | S | 10/2010 | Petlak et al. | |
| D634,971 | S | 3/2011 | Petlak et al. | |
| 2003/0094393 | A1 * | 5/2003 | Sahm, III | 206/505 |
| 2008/0110790 | A1 * | 5/2008 | McTavish et al. | 206/511 |
| 2008/0190930 | A1 * | 8/2008 | Vogel et al. | 220/276 |

* cited by examiner

*Primary Examiner* — Fenn Mathew
*Assistant Examiner* — Cynthia Collado
(74) *Attorney, Agent, or Firm* — Baker Botts L.L.P.

(57) ABSTRACT

Container including a bottom and sidewalls with undulating pattern of peaks and valley. At least one stacking feature is provided to allow a plurality of containers to be stacked. In one embodiment, the stacking feature is disposed proximate a bottom edge of the sidewall at a peak. In another embodiment, the stacking feature is a stack flap disposed proximate a top edge of the container. Alternatively, the stacking feature is a stack ring having a shape which corresponds to the sidewall perimeter and has an inwardly protruding lip.

39 Claims, 21 Drawing Sheets

CONTAINER WITH STACKING FEATURE

BACKGROUND OF THE INVENTION

1. Field of the Invention

The disclosed subject matter relates to food containers and, more particularly, to a container having a sidewall configuration that allows for multiple containers of similar configuration to be stacked on top of each other when in a first orientation, and nested within each other when in a second orientation.

2. Description of Related Art

A variety of container designs are known for packaging and transport of food items. It is often desirable for containers to be stacked in order to allow a customer to carry or store several containers at once. Such conventional containers generally require a lid or cover member to provide a support surface for the stacked container to be positioned above. Generally, such configurations have been considered satisfactory for their intended purpose.

However, the presence of a cover member often conceals the food item positioned within the container and can present a less aesthetically appealing display. Further, there is a cost benefit for a container which does not require a cover member, yet still allows a second container to be stacked on top of a first container, without engaging the food product positioned therein. Also, container designs which incorporate a cover member are typically not able to be nested within each other, but instead have the base of one container rest on top of the cover member of a second container. This results in a stacked container having an undesirable height which requires a large storage space to accommodate the plurality of containers.

Accordingly, it would be advantageous to provide a container capable of being both stacked and nested efficiently, without the need for a lid or cover, so as to reduce the costs associated with transporting and/or storing the containers. It would also be desirable to prevent or inhibit shifting or sliding between adjacent containers.

SUMMARY OF THE INVENTION

The purpose and advantages of the disclosed subject matter will be set forth in and apparent from the description that follows, as well as will be learned by practice of the disclosed subject matter. Additional advantages of the disclosed subject matter will be realized and attained by the methods and systems particularly pointed out in the written description and claims hereof, as well as from the appended drawings.

To achieve these and other advantages and in accordance with the purpose of the disclosed subject matter, as embodied and broadly described herein, a novel food container structure is disclosed which provides a significant reduction in cost and also provides a method of stacking food containers to provide improved visibility and venting of the food product contained therein. Particularly, the disclosed subject matter includes a container comprising a bottom having a periphery, and a side wall extending generally upward from the bottom with the sidewall configured to extend around the periphery in an alternating pattern of peaks and valleys to define an interior of the container. The sidewall defines a top edge and a bottom edge, and at least one stacking feature disposed proximate the bottom edge of the sidewall such that the at least one stacking feature is located at a peak. The stacking feature allows for a second container of similar configuration to be positioned or stacked on top of the first container without the need for a lid or cover.

In accordance with an aspect of the disclosed subject matter, the stacking feature of a second container is disposed at a peak and configured to engage the top edge of a valley of a first container. Preferably, the containers are capable of being stacked when in a first orientation, and nested within each other when in a second orientation.

Additionally, the sidewall can include an even number of peaks, with a stacking feature disposed at alternating or adjacent peaks. The bottom of the containers can define a generally circular periphery or a non-circular periphery, as desired. Furthermore, the bottom can include a food product centering feature such that the food product is spaced from the sidewall when disposed within the container. In some embodiments, the stacking feature is spaced from the product centering feature, and is configured as a recess extending towards the interior of the container. Apertures can be included within the bottom for additional venting. Also, the stacking feature can extend along a portion of the sidewall and along a portion of the bottom. Additionally, the container can include a plurality of ribs having a first end in the sidewall and a second end in the bottom, with the stacking feature disposed in-between the first and second ends of the ribs. The plurality of ribs can extend inwardly a first distance, and the stacking feature extends inwardly a second distance, with the second distance being greater than the first distance. The bottom and sidewall is preferably made of talc-filled polypropylene, or other suitable cost efficient materials.

In accordance with another aspect of the disclosed subject matter, a container is provided with a bottom having a periphery and a side wall extending generally upward from the bottom about the periphery. The sidewall is formed with an alternating pattern of peaks and valleys to define an interior of the container as well as top and bottom edges. A plurality of stack flaps can be disposed proximate the top edge, with each stack flap having a first position with the stack flap extending outwardly from the exterior of the container, and a second position with the stack flap extending inwardly toward the interior of the container. Additionally, a plurality of containers can be configured in a stacked relationship. When configured in the stacked relationship, the bottom of a second container is disposed on the stack flap of a first container to form a stack of containers when the stack flap is in the second position. The stack flaps are hingedly connected to the top edge of the container such that the hinge forms a stiffening member and/or handle at the top edge of the container when in the second position. Additionally, each container can include a stacking feature at the bottom edge.

In accordance with yet another aspect of the disclosed subject matter, a stack of containers comprising a plurality of containers in a stacked relationship is provided. Each container has a bottom, and a side wall extending around the periphery in an undulating pattern of peaks and valleys to define an interior of the container and a top edge and a bottom edge. The stack of containers can further include a stack ring having an undulating pattern of peaks and valleys, which correspond with the contour of the sidewall, and is disposed at the top edge of a first container. Wherein the stack ring has a generally open center and an interior lip which extends inwardly towards the interior of the container. When configured in a stacked position, the bottom of a second container is disposed on the interior lip of the stack ring to form a stack of containers. Additionally, each container can include a stacking feature at the bottom edge.

It is to be understood that both the foregoing general description and the following detailed description are exemplary and are intended to provide further explanation of the disclosed subject matter claimed.

The accompanying drawings, which are incorporated in and constitute part of this specification, are included to illustrate and provide a further understanding of the method and system of the disclosed subject matter. Together with the description, the drawings serve to explain the principles of the disclosed subject matter.

DETAILED DESCRIPTION OF THE PREFERRED EMBODIMENT

Figure 1:
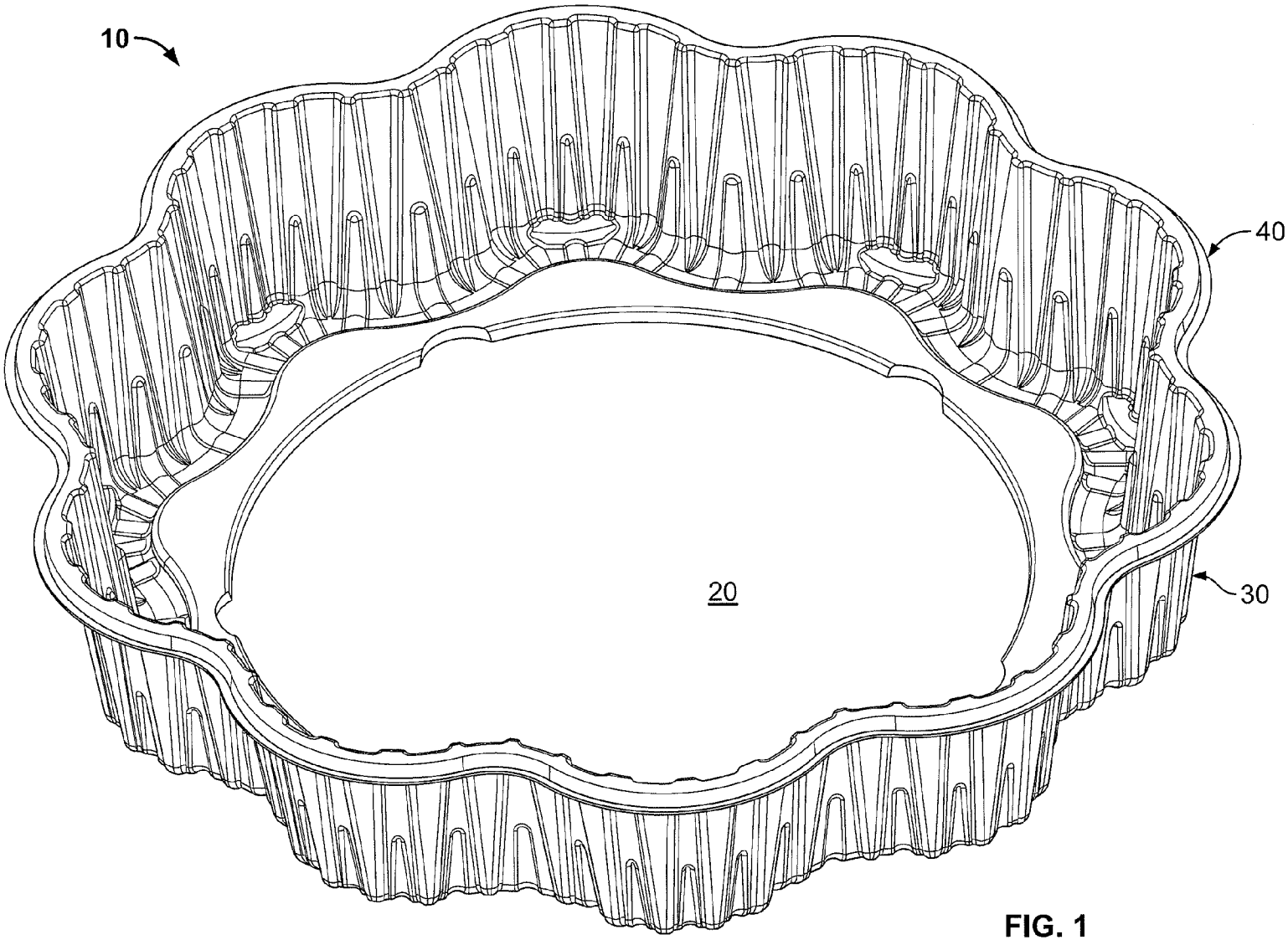
FIG. 1 is a schematic representation of a perspective view of an exemplary embodiment of the container in accordance with the disclosed subject matter.

Reference will now be made in detail to the present preferred embodiments of the disclosed subject matter, an example of which is illustrated in the accompanying drawings. The method and corresponding steps of the disclosed subject matter will be described in conjunction with the detailed description of the system.

The methods and systems presented herein can be used for transporting and displaying food items. The disclosed subject matter is particularly suited for stacking a plurality of containers. In accordance with an aspect of the disclosed subject matter, a container is disclosed comprising a bottom having a periphery and a side wall extending generally upward from the bottom. The sidewall is configured to extend around the periphery in an alternating pattern of peaks and valleys to define an interior of the container, and the sidewall further defines a top edge and a bottom edge. At least one stacking feature is disposed proximate the bottom edge of the sidewall, such that the at least one stacking feature is located at a peak.

In a first orientation, a stack of similarly shaped containers can be arranged in which a second container is received on top of a first container wherein the stacking feature of the second container is disposed at a peak and configured to engage a valley of the first container at a top edge of the sidewall. Also, in a second orientation, the second container can be nested within the first container such that the peaks of the second container coincide with the peaks of the first container.

The accompanying figures, where like reference numerals refer to identical or functionally similar elements throughout the separate views, serve to further illustrate various embodiments and to explain various principles and advantages all in accordance with the disclosed subject matter. For purpose of explanation and illustration, and not limitation, an exemplary embodiment of the system in accordance with the disclosed subject matter is shown in FIG. 1 and is designated generally by reference character 10.

Figure 2A:
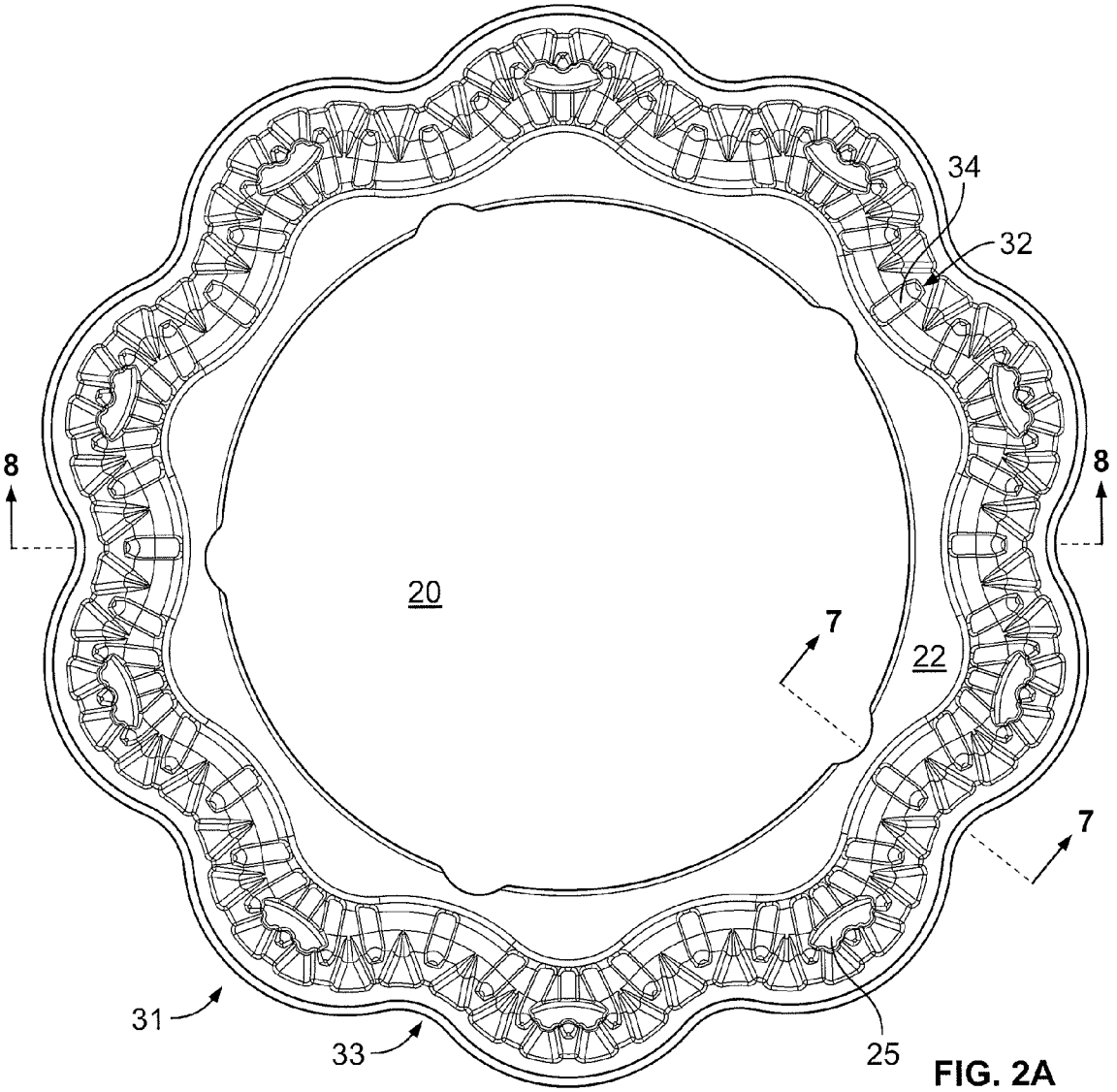
FIG. 2A is a plan view of the container shown in FIG. 1.
Figure 2B:
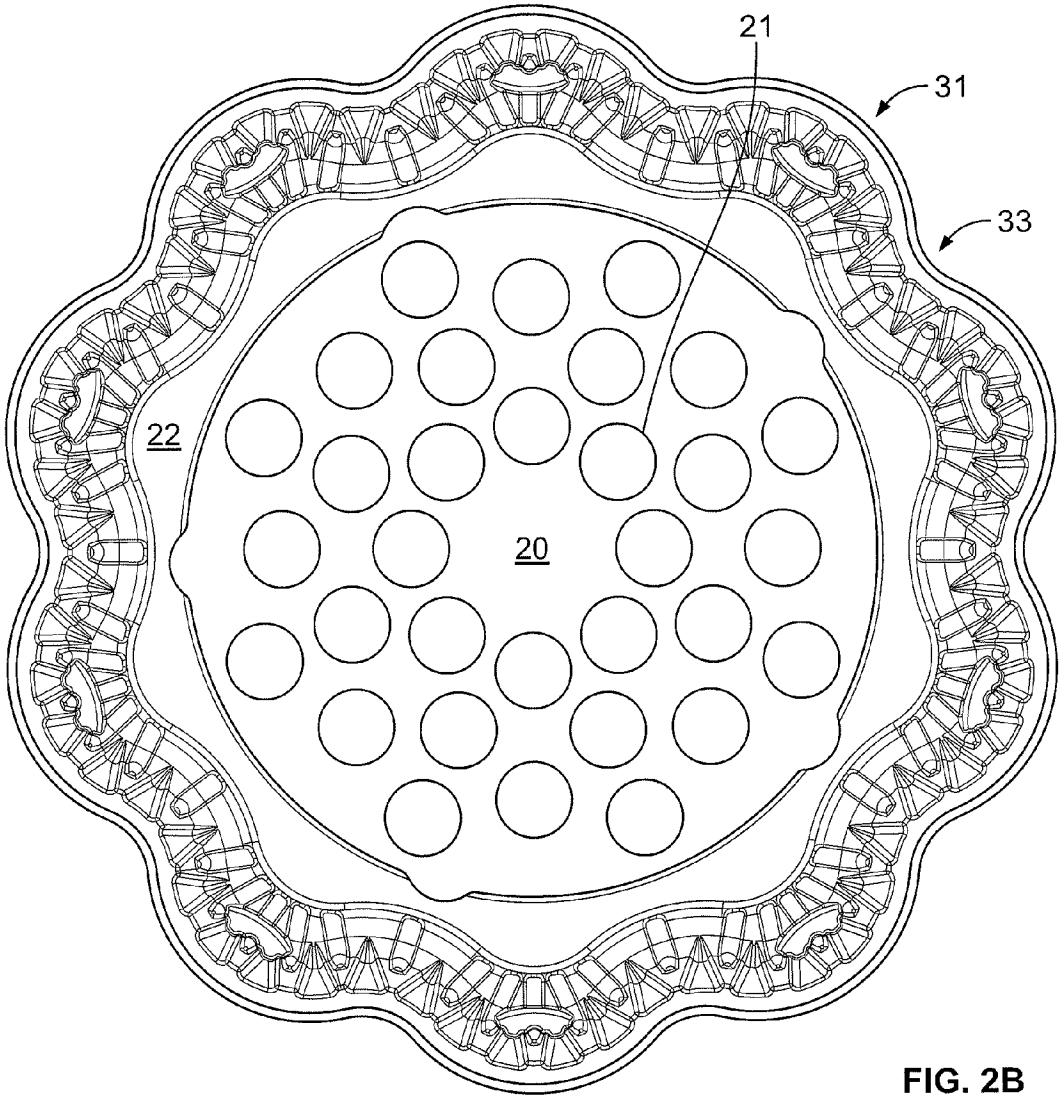
FIG. 2B is a plan view of the container shown in FIG. 1, depicting apertures formed in the bottom.
Figure 3:
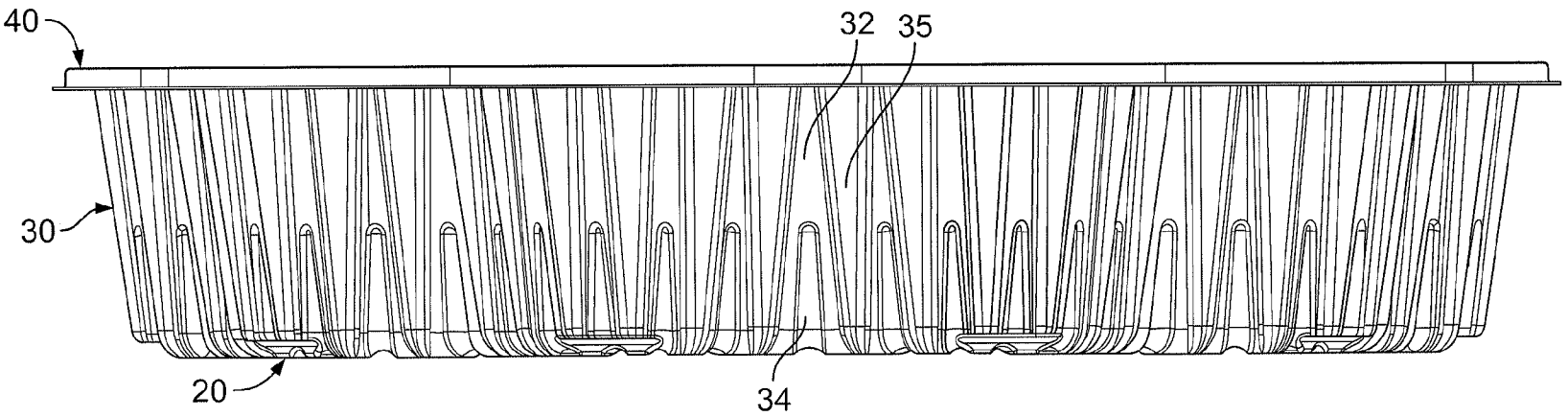
FIG. 3 is a side view of the container shown in FIG. 1.

Referring to FIGS. 1-3 a container (e.g., a first container 10) to be used in one embodiment of the disclosed subject matter is shown. The container 10 includes a bottom 20 and a side wall 30 that extends around the periphery of the bottom 20 and extends upwardly from the bottom. If desired or needed, such as for additional strength, a flange 40 is disposed at the top edge of the sidewall. The sidewall is configured with an undulating pattern of peaks 31 and valleys 33. This undulating pattern of peaks and valleys define a top edge of the container about which a second container can be positioned and maintained in a stacked relationship. For example, and as depicted in the embodiment herein, the containers have a generally circular bottom and the peaks 31 and valleys 33 are formed with a generally arcuate shape. Alternatively, the undulating pattern can be formed with peaks and valleys having rectilinear, sawtooth or other suitable configurations as desired. Furthermore, the bottom can be provided with a non-circular shape, such as a square, triangle, or other polygonal shape. Preferably, if provided, the flange 40 positioned at the top edge of the sidewall 30 is formed with a corresponding undulating pattern as defined by the sidewall. Also, it is contemplated that the flange 40 need not extend around the entire sidewall.

The bottom, side wall and flange can be integrally formed to provide a continuous structure, or alternatively, can be discrete elements joined together to form the container 10. In some embodiments, the sidewall 30 can project perpendicularly upward from the bottom 20 or alternatively, can project upwardly and outwardly from the bottom 20. Similarly, the side wall can extend linearly or be contoured into a bowl-like shape or other non-linear fashion.

It is desirable that the container 10 is shaped and sized to permit stacking of similarly shaped containers without the need for a lid or rigid cover member. The use of such a lid typically increases the stacking height of the containers, as well as material and production costs. It is desirable to minimize the stacking height of the containers in order to reduce transportation and packaging costs, as well as to provide space efficiency in retail and consumer settings. However, in some embodiments the container can be used in combination with a lid, if so desired. Additionally, or alternatively, the container can be provided with a film overwrap to protect the food contents from contamination. Such a film overwrap would have with sufficient flexibility such as to not obstruct the mating of the stacking feature of a second container with the flange of a first container, as discussed in further detail below.

The container can be formed from a variety of suitable materials, including polymeric materials. In a preferred embodiment, the polymeric container is formed from polyolefins. The polymeric food container can also be formed from orientated polystyrene (OPS), polyethylene terephthalate (PET), polyvinyl chloride (PVC), polypropylene, and/or combinations thereof. In a more preferred embodiment, the container is made from a mineral-filled polymeric material such as, for example, talc or calcium carbonate-filled polyolefin. Alternatively, the container can be formed from other suitable materials such as paper or metal, if desired. An example of paper that can be used in forming the containers is paperboard or molded fiber. Paperboard and molded fiber typically have a sufficient coefficient of friction to maintain the first and second containers in a lockable position.

In a preferred embodiment, the container is formed from talc-filled polypropylene which allows for a reduction in weight of approximately 50% compared to conventional container designs. Additionally, as illustrated in FIG. 2B, holes 21 can be formed in the bottom of the container to reduce an additional 10-15% of the polymer material, thereby further reducing the weight and cost associated with the container. For example, material can be punched-out material can be recycled for further material savings. These holes also provide an additional function of increasing the venting of the food items placed within the container. Also, in applications in which the container is employed to support pre-packaged food items such as a food item overwrapped using a thin film, the use of such holes does not affect the containment of the food item.

If desired, the container 10 can be strengthened by including a pattern or array of ribs such that the container 10 does not have a straight path of bending. Examples of a container having a variety of ribs and rib units of multiple angles and multiple depths is disclosed in U.S. Pat. Nos. 7,228,986 and 6,619,501, the entirety of which are hereby incorporated by reference.

Figure 4:
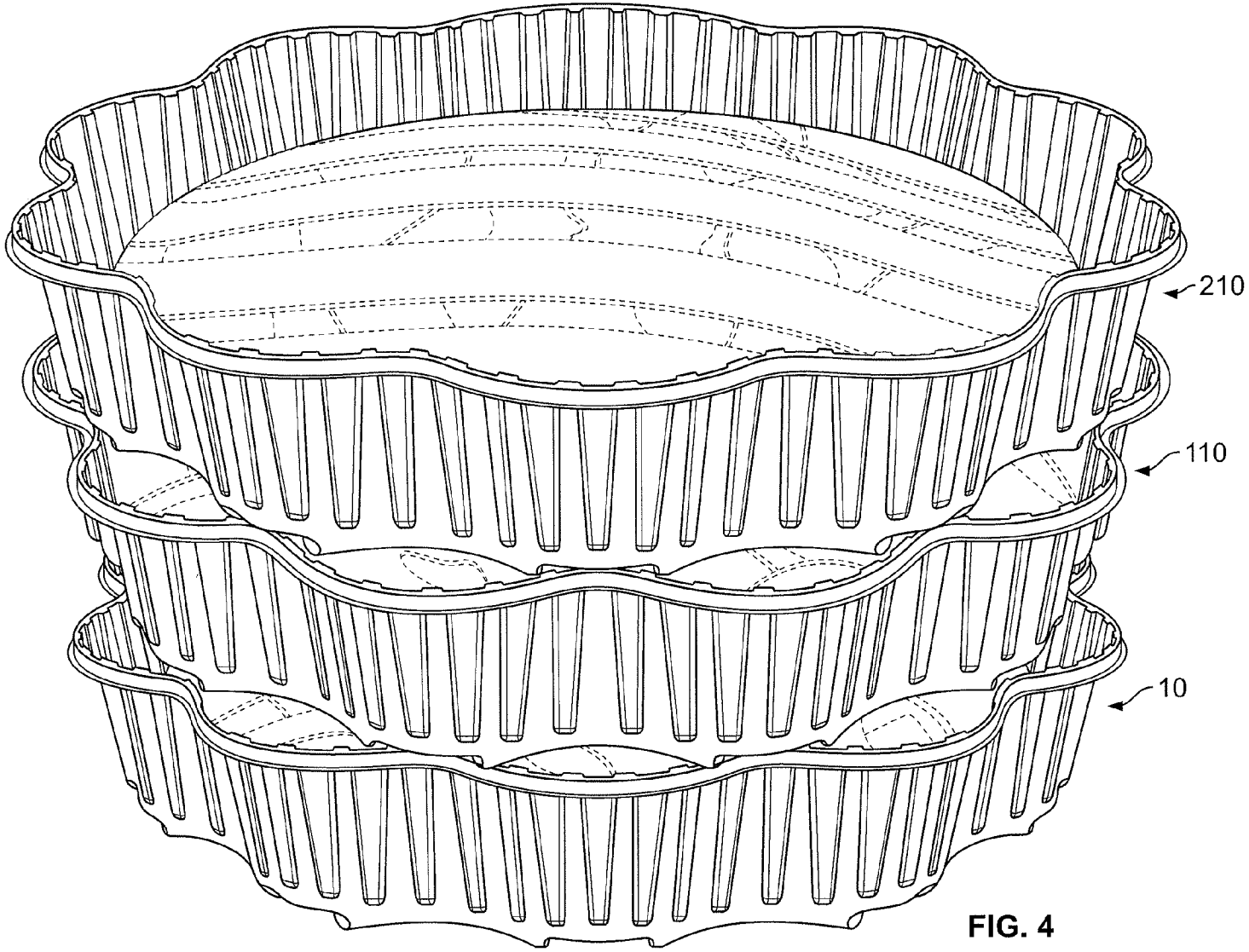
FIG. 4 is a perspective view of a stack of containers in accordance with the disclosed subject matter.

For purpose of illustration, and not limitation, FIGS. 2-3 show a rib unit formed into the side wall 30 and including a first rib 32, and a second rib 34 formed in the first rib 32 such that the two ribs share a common central axis. Although both of the ribs 32, 34 are depicted as male ribs which extend towards the interior of the container, single rib units as shown in FIG. 4, and/or combinations of female ribs and male ribs are also contemplated. In one embodiment, the first rib 32 extends the entire length of the sidewall from adjacent the flange 40 to adjacent the bottom 20. The second rib 34 is shorter than the first rib 32 and extends from a position approximately at the midpoint of sidewall 30 through the bottom edge and into the bottom 20. Additionally, in some embodiments, the second ribs 34 extend into the bottom a distance and terminate at the boundary of the product centering feature 22, as shown in FIG. 2A. The ribs 32, 34 can be formed with rounded surfaces to prevent acute stress points as is common with planar rib configurations.

Figure 6:
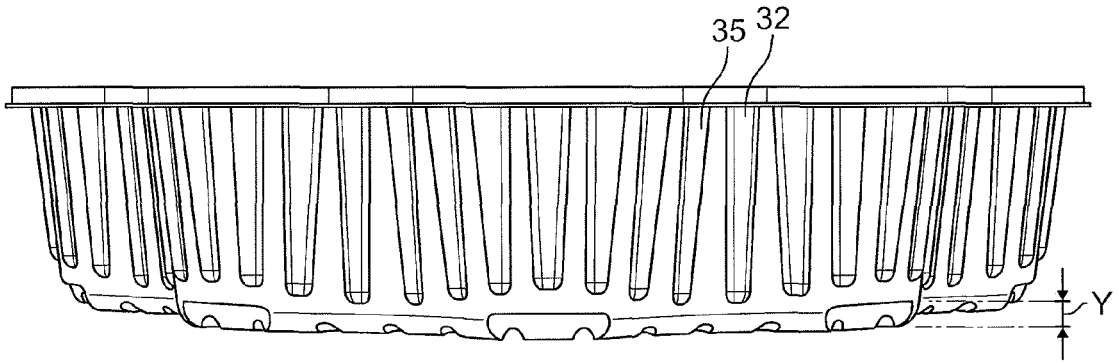
FIG. 6 is a side view of a container having an alternative rib configuration.

This rib unit arrangement can be repeated around the entire side wall 30 to form a pattern or array. The pattern can be a plurality of rib units positioned adjacent to each other or spaced apart with portions of the side wall 30 positioned between rib units. The depth that any rib extends either inwardly towards the interior of the container, or outwardly towards the exterior of the container, is measured with respect to the sidewall reference surface 35 (as shown in FIGS. 3 and 6). It is this sidewall reference surface 35 which defines the peaks 31 and valleys 33 of the container. Accordingly, the ribs are a separate and discrete structure from the peaks 31 and valleys 33 such that any given peak 31 or valley 33 can include a plurality of ribs 32,34.

In some embodiments, the ribs 32, 34 can be formed at varying depths and angles such that when a plurality of containers are configured in the second orientation (i.e. nested within an adjacent container) the ribs of an inner container abut the ribs of the outer container so as to maintain a spaced relationship between adjacent containers. In other words, the flange of the inner container is spaced above the flange of the outer container, thereby facilitating efficient removal or denesting of adjacent containers. Moreover, this spacing between the containers can extend along the entire sidewall height to thereby prevent undesired abrasion or damage to either sidewall due to frictional forces. Also, the rib configurations can serve as an anti-rotation interlock feature which prevents or inhibits relative rotation of adjacent containers. Additionally, the undulating pattern of peaks and valleys can also serve as an anti-rotation interlock feature when a plurality of containers are configured in the second orientation (i.e. nested within an adjacent container) in that the peak 31 of one container is positioned within a peak 31 of another container and is thereby positioned between two valleys 33 which inhibit relative rotation between the two containers.

As embodied herein, for illustration and not limitation, the bottom includes a bottom wall 20 having two different levels or heights in the bottom. A second level or height is defined by a product centering feature 22 formed in the bottom 20. The product centering feature 22 can be raised or elevated with respect to the bottom wall, and is sized to receive the food product such that the center of the food product (e.g. a pie, as shown in phantom in FIG. 4) is aligned with a central axis extending perpendicular to the bottom. The product centering feature 22 preferably forms a uniform space between the edge of the food product and the interior of the sidewall 30. This space is advantageous for centering the food product for display and allowing a consumer to easily and securely grip the food product for removal from the container 10. Further, this space between the product centering feature 22 and the sidewall 30 can serve as a channel or reservoir for accumulating any seepage or discharge from the food items placed within the container or debris otherwise present within the container. In some embodiments the product centering feature 22 can be configured as a circumferential rib which extends around the entire periphery of the bottom to provide enhanced strength and rigidity.

Figure 5:
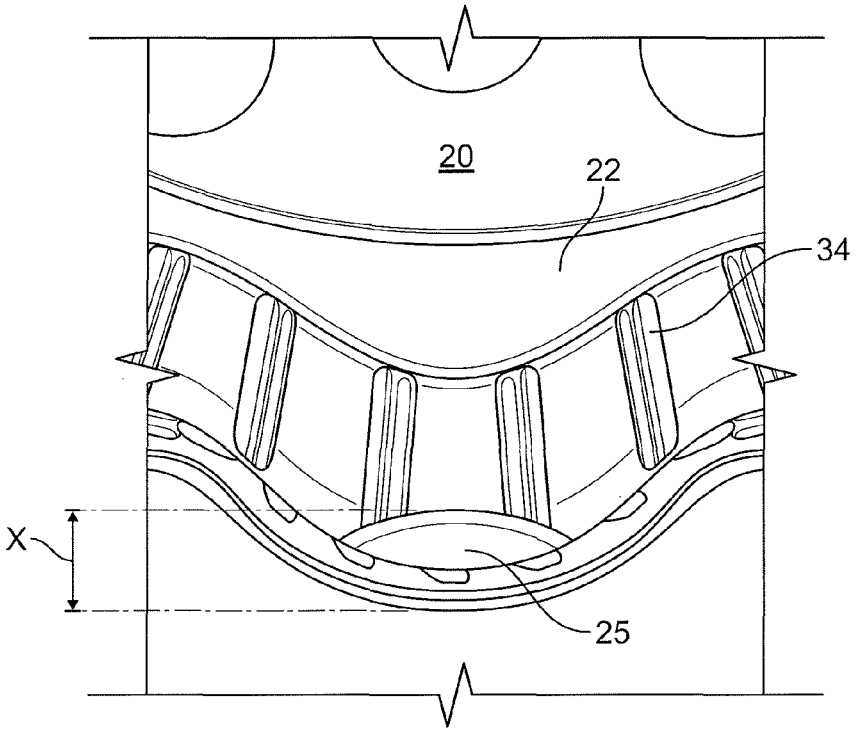
FIG. 5 is a detail view of an exemplary embodiment of the stacking feature in accordance with the disclosed subject matter.
Figure 7:
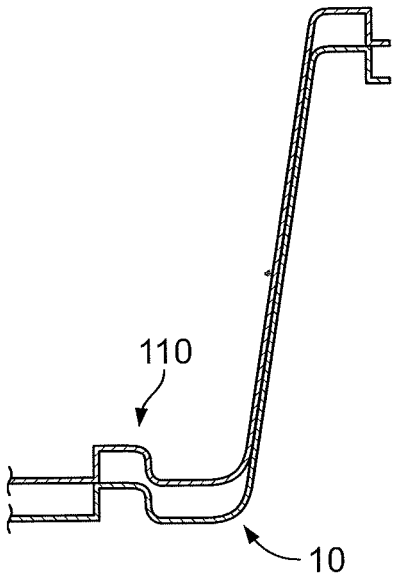
FIG. 7 is a cross-sectional view of two nested containers, as viewed along line 7-7 in FIG. 2A.

In accordance with another aspect of the disclosed subject matter, the container 10 includes a stacking feature 25 to allow for convenient and secure stacking of a plurality of containers, as best shown in FIGS. 2A and 5. The stacking feature disposed proximate the bottom edge of the sidewall at at least one peak. Preferably, a plurality of stacking features are provided. In this manner, containers of similar configuration can be stacked on top of each other, when in a first orientation relative to each other such that the peak of one container is aligned with the valley of an adjacent container. By contrast, with the containers in a second orientation, such that the peaks and valleys of adjacent containers are aligned, the containers can be nested inside of each other for reduced volume or height when no food items are stored therein, as shown in FIG. 7. Furthermore, when the containers are arranged in the first orientation, i.e. in a stacked relationship, the valley of second container 110 is positioned above the peak of the first container 10 to define a space or gap between the two containers. This gap provides venting of the food items placed within the container, as well as increases the visibility of the food items.

While it is preferred that the stacking features be shaped and sized to minimize the stacking height of the containers, it is contemplated that the shape and size of the stacking features can vary from those shown in the attached drawings. In a preferred embodiment, a flange is provided and it is desirable for the stacking feature 25 of a first container to be of generally the same size and dimensions as the corresponding flange 40 of a second container to inhibit or prevent lateral or rotational movement of the containers relative to each other.

In one embodiment, the stacking features 25 and flanges 40 of the first container 10 and the second container 110 are substantially identical. Having substantially identical stacking features on adjacent flange and bottom container surfaces is desirable because it eliminates the need to match a container having a first stacking feature to a second container having a similar second stacking feature, thus promoting ease and efficiency in stacking. Furthermore, by requiring only one container configuration there is a benefit of reduced cost and complexity.

As embodied however, for purpose of illustration and not limitation, it is preferable that the container be formed with an even number of peaks 31 to allow one container to be stacked upon another container when in the first orientation. As the illustrated embodiment depicts, the container is formed with ten peaks, with each peak 31 including a stacking feature 25 formed at the bottom of the container. When two containers are stacked, the stacking feature 25 disposed in peak 31 of a second container is configured to mate with the top edge in valley 33 of a first container. The formula providing the minimum degree in which the second container need be rotated about its central axis from the second orientation (i.e. wherein the peaks of adjacent containers are aligned) with respect to the first container is $2\pi$/(number of peaks*2). Thus, for the illustrated embodiment having ten peaks 31, the minimum distance that container 110 need be rotated with respect to container 10 is 18 degrees (i.e., 360/20). However, alternative amounts of rotation are possible, provided that the stacking feature in the peak of a second container is positioned to engage the top edge in a valley of a first container.

Figure 8:
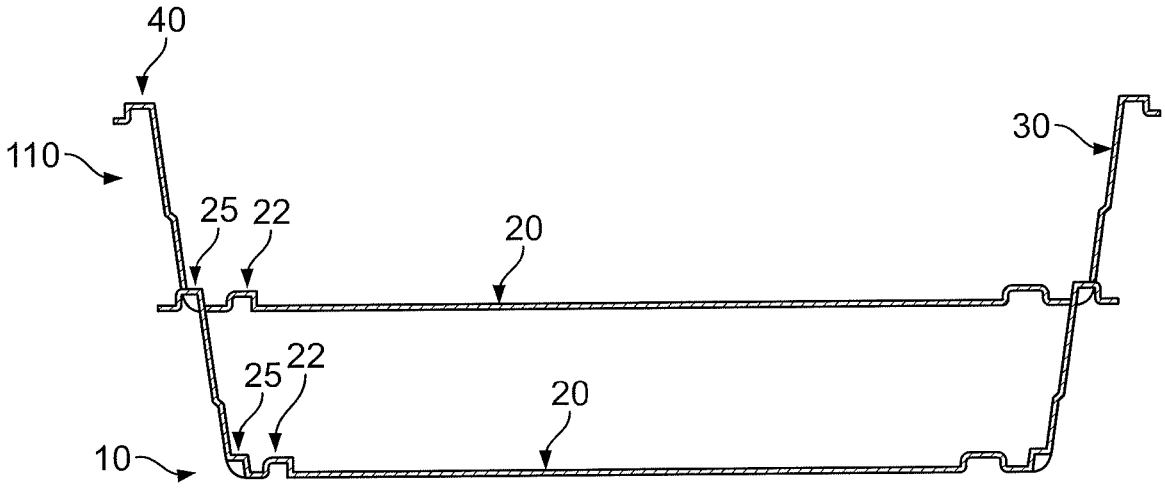
FIG. 8 is a cross-sectional view of two stacked containers, as viewed along line 8-8 in FIG. 2A.

The stacking feature 25 is located at the peak 31 such that the stacking feature extends a distance "x" into the bottom 20, as well as a distance "y" into sidewall 30 such that the stacking feature 25 forms a stepped recess or indentation with respect to both the sidewall 30 and the bottom 20, as shown in FIGS. 5-6. Accordingly, when a plurality of containers are arranged in the stacked configuration the stacking feature 25 of a second container 110 matingly engages the top (e.g. flange) of a first container 10 such that the bottom 20 of the second container is positioned within the interior of the first container. In other words, the bottom of the second container 110 is positioned below the top edge (e.g. flange) of the first container 10, as shown in FIG. 8.

As discussed above, stacking feature 25 of a first container is preferably of generally the same size and shape as the corresponding flange 40 of a second container in order to inhibit or prevent lateral or rotational movement of the containers relative to each other. In an exemplary embodiment, the stacking feature 25 of the second container 110 can be formed with an arcuate shape and extend inwardly a distance "y" which coincides with the radius of curvature of the flange 40 of a the first container.

Additionally, the stacking feature can be configured to extend towards the interior of the container and be positioned to interrupt ribs 32, 34. Preferably, the stacking feature 25 extends inwardly a greater distance than the ribs 32, 34. Although the illustrated embodiments depict stacking feature 25 having a generally arcuate shape, it is also contemplated that the stacking feature can be in the form of other shapes including, but not limited to rectangular, square, hexagonal, octagonal, other polygonal shapes, or oval. Similarly, a mating stacking feature (not shown) can be disposed on the flange, if provided, to mate with the stacking feature 25 on the bottom of the adjacent container. This mating stacking feature will further ensure alignment and prevent slippage during transport. The stacking feature 25 can also include ribs or a textured surface to increase the frictional forces and further inhibit relative movement of the stacked containers. The textured surfaces can have a uniform pattern, or they can be random, or can be a separate material applied to the stacking feature 25 and/or flange 40.

Figure 10:
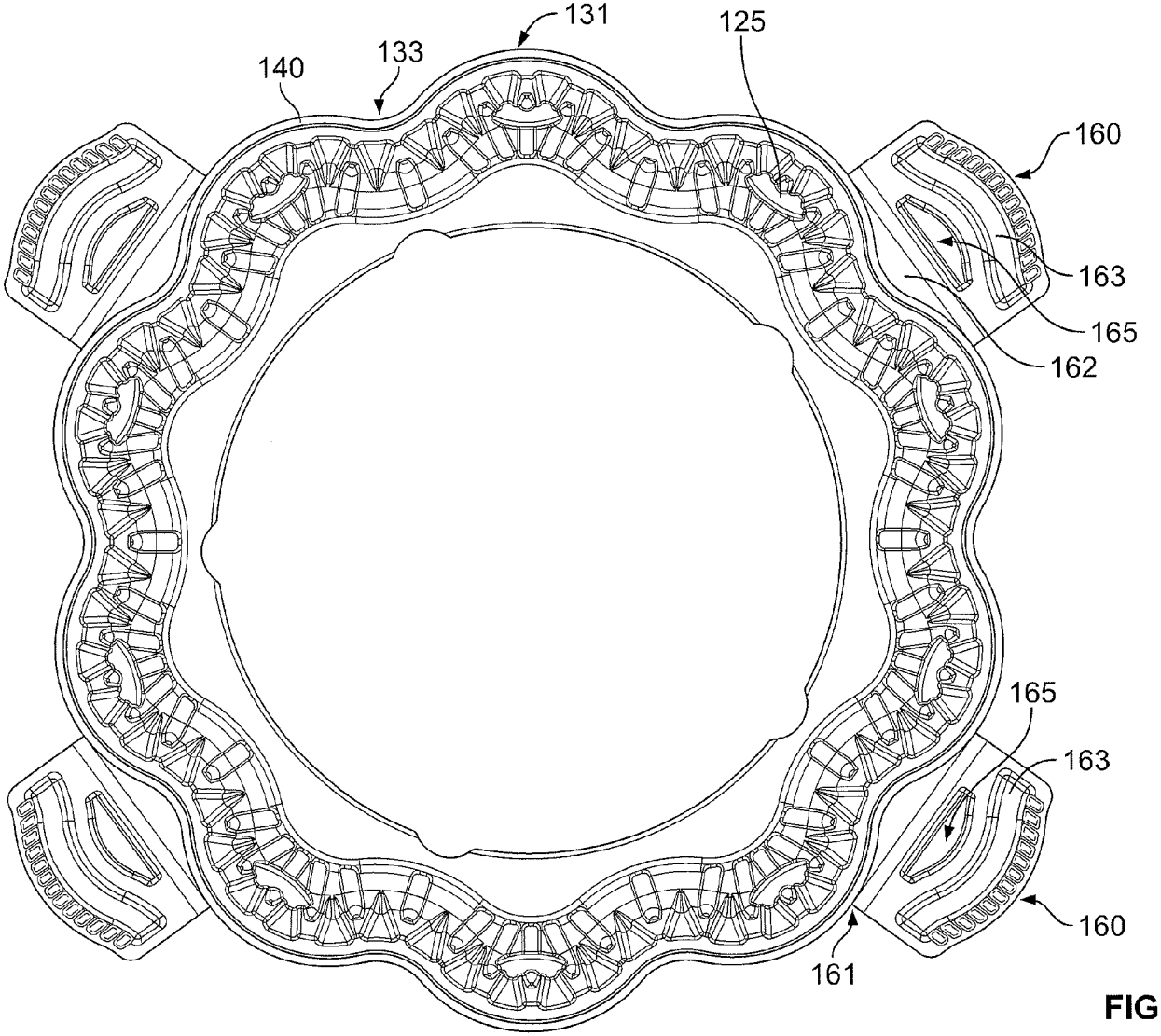
FIG. 10 is a plan view of a container having stack flaps in a first position, in accordance with the disclosed subject matter.
Figure 11:
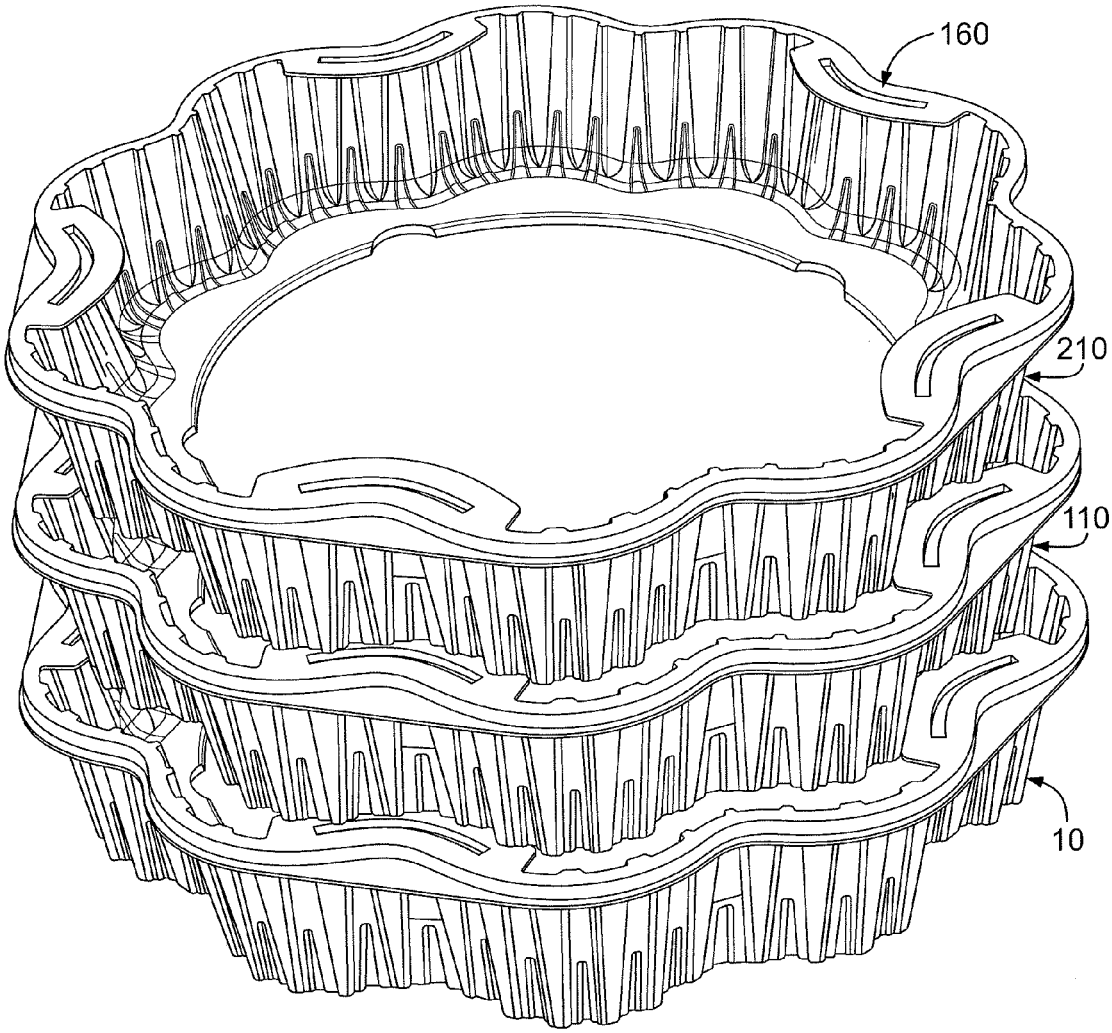
FIG. 11 is a perspective view of a stack of containers and having stack flaps.
Figure 12:
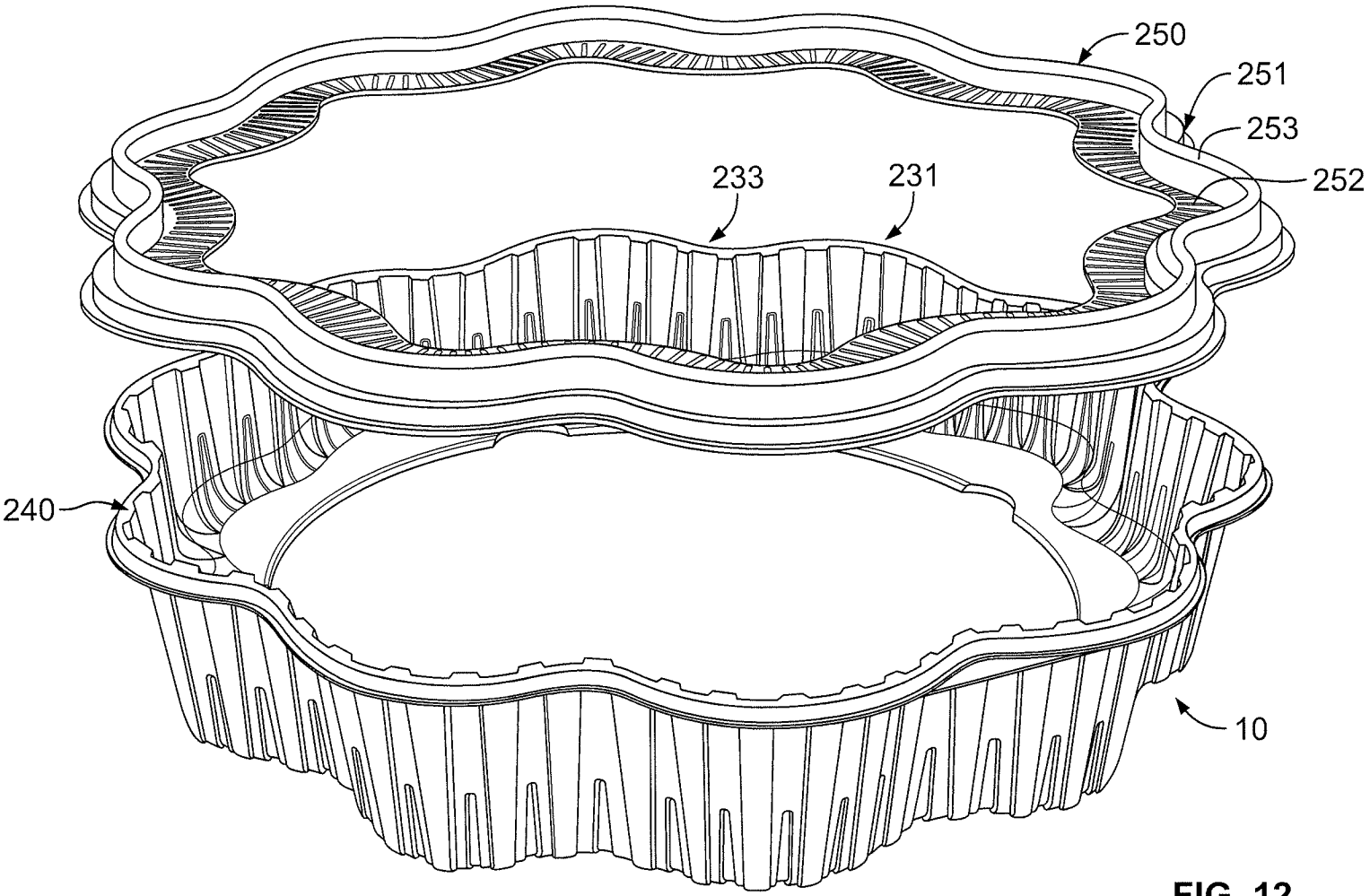
FIG. 12 is an exploded view of a container and a stack ring in accordance with the disclosed subject matter.

In accordance with another aspect of the disclosed subject matter, the stacking feature can include a flap formed proximate the top (e.g. flange) of each container. For example, and as shown in FIGS. 9-11, the stack flaps 160 are integrally formed with the container and can be transitioned or moved between first and second positions, as described below. The stack flaps 160 therefore can be used in combination with the stacking feature 125, as described above. The stack flaps 160 allow for convenient and rapid stacking of containers, as well as greater stability than using the stacking feature 125 alone. Alternatively, if relative rotation of the containers is not desired and/or if venting between the stacked containers is not necessary, the stack flaps 160 allow for stacking without the use of the stacking feature 125, as shown in FIG. 9B. Particularly, a plurality of containers can be stacked upon each other such that the peaks and valleys of the first container are aligned with the peaks and valleys of the second container, as shown in FIG. 11.

In an exemplary embodiment, the stack flaps 160 are located at select valleys 133 and are attached to the outer periphery of the flange 140 by a hinge portion 161. In the embodiment illustrated in FIG. 11, five stack flaps 160 are provided, however the particular number and location of the stack flaps 160 can be varied, as so desired. Similarly, the shape and size of the stack flaps 160 can be varied, as so desired. The hinge portion 161 allows the stack flap to transition between a first and second position.

Figure 9A:
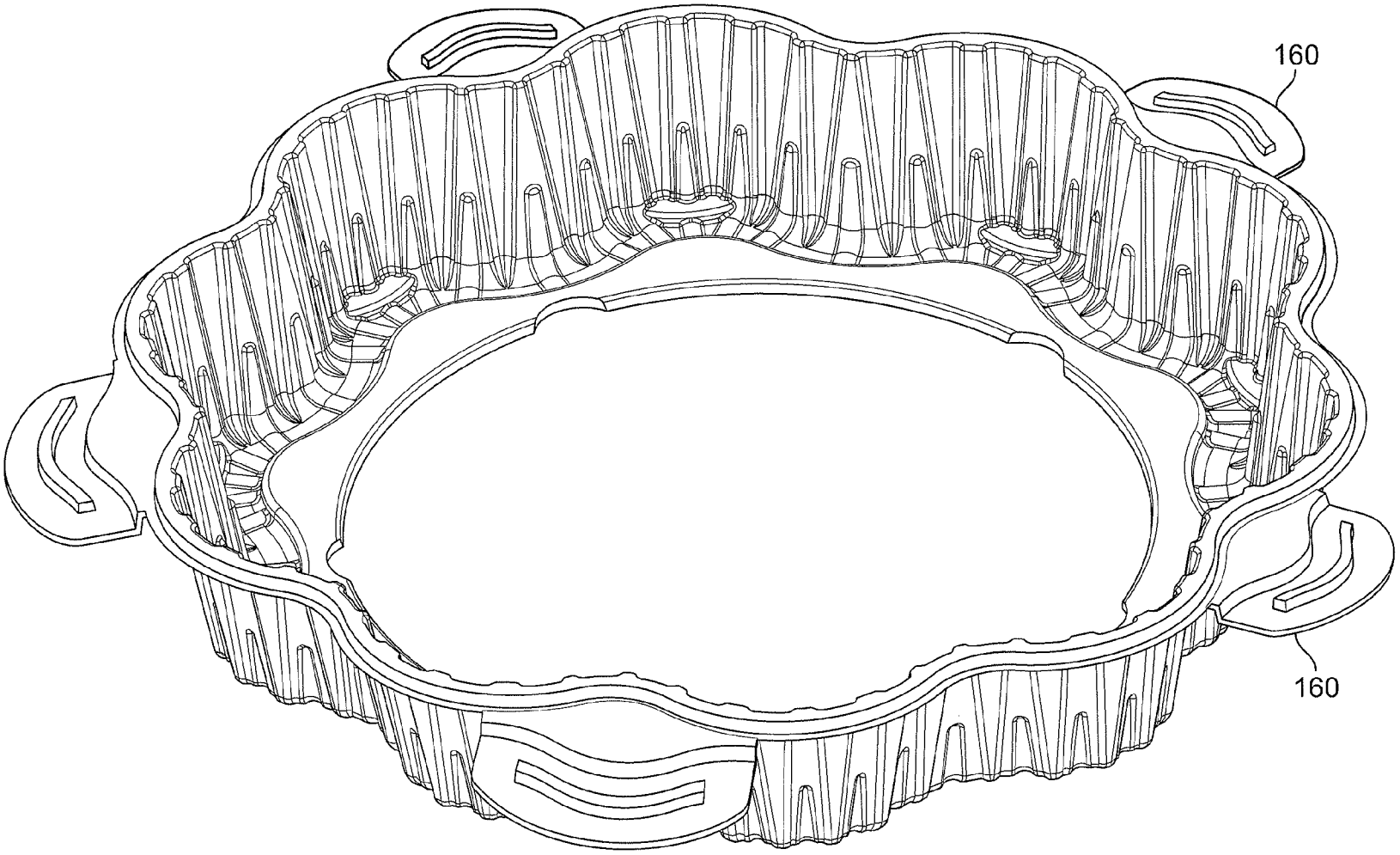
FIG. 9A is a perspective view of a container having stack flaps in a first position, in accordance with the disclosed subject matter.
Figure 9B:
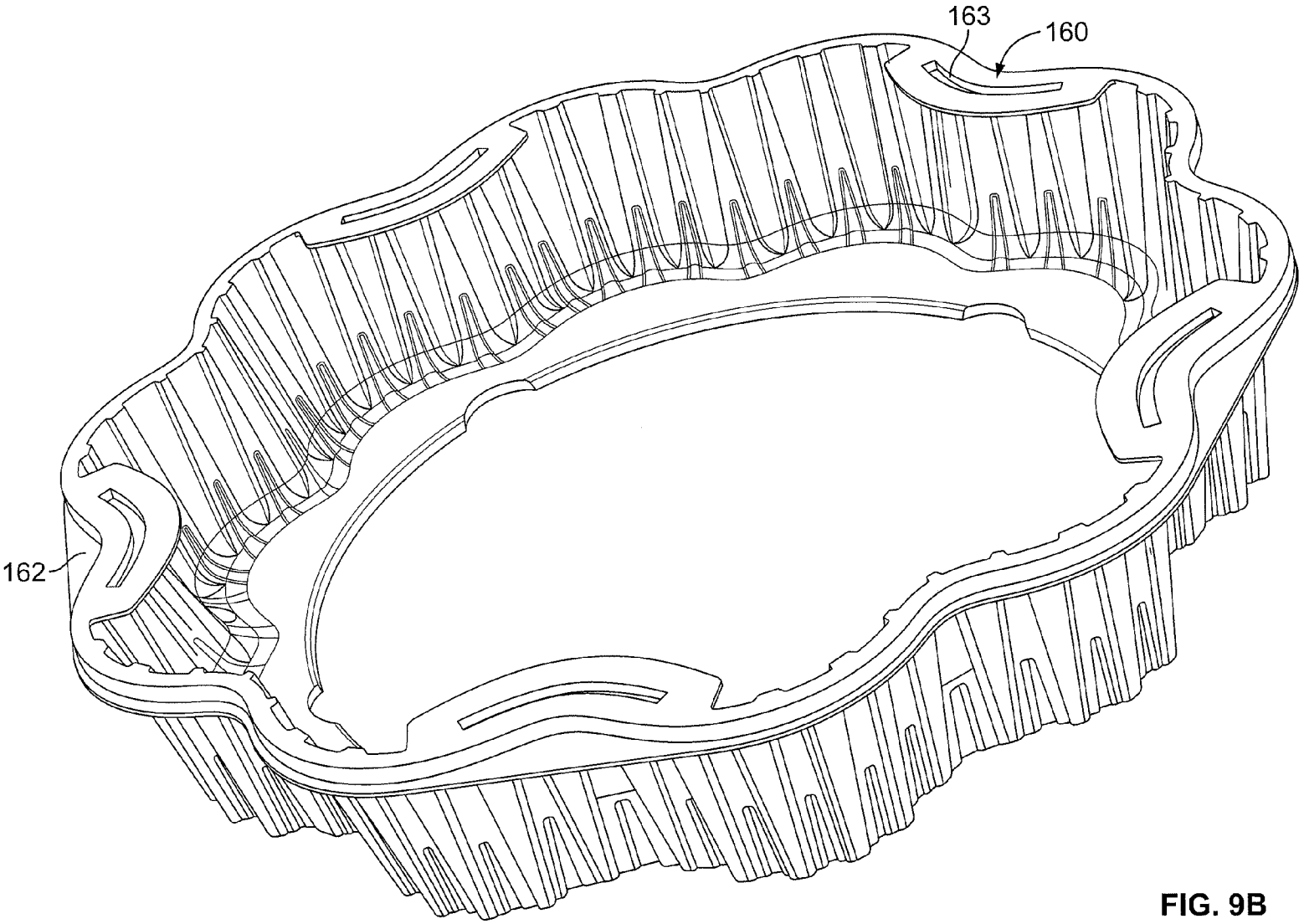
FIG. 9B is a perspective view of a container having stack flaps in a second position, in accordance with the disclosed subject matter.

In the first position shown in FIG. 9A, the stack flap 160 is configured to extend outward from the container such that the stack flap 160 does not obstruct access to the interior of the container. In the embodiment illustrated in FIG. 9A, the stack flap extends in a generally horizontal direction from the outer periphery of the container flange 140. Alternatively, the stack flap 160 can be configured such that when in the first position the stack flap 160 extends downward in a generally vertical direction such that the stack flap is generally parallel to the sidewall 130. Alternatively, the stack flap 160 can be configured to extend at any angle from the flange 140, as so desired. While the stack flap 160 is in this first position, a second container can be received within a first container in a nested relationship for shipment or storage.

In the second position shown in FIG. 9B, the stack flap 160 is moved or rotated about the hinge portion 161 such that the stack flap extends over the flange 140 and inwardly towards the center of the container. With the stack flap 160 in this second position, the stack flap extends inwardly a distance sufficient to engage the bottom of a second container placed thereupon, to maintain a stacked relationship between containers.

The hinge portion described herein can be formed by any means well known in the art. Preferably, the hinge portion comprise lines of weakness, reducing the bending force across that hinge portion and allowing the stack flaps 160 to fold in a predetermined manner. Suitable hinge portions include score lines, and perforations if the intended use does not involve liquids. Also, material can be cut or removed from the food container to form the hinge portion. Preferably, however, material is compressed or densified to form the hinge portion. Scoring design and techniques are also well known in the art.

In the illustrated embodiment, the stack flap 160 is attached to the top (e.g. flange 140) of the container with the ends of the stack flap located at adjacent peaks 131. When the stack flap 160 is in the second position, the hinge portion 161 defines a flange with a straight exterior edge 162 at the top (e.g. flange) of the container, with the remainder of the flange and sidewall having an alternating peak and valley shape, as shown in FIG. 10. This flange can function as a handle for carrying the container as well as further strengthening the container sidewall. A plurality of position retention features 163, 165 can be formed in the stack flap 160. For example, a first position retention feature 163 is positioned to matingly engage the interior surface of the top of the container (e.g. flange) when the stack flap 160 is in the second position. Similarly, a second retention feature 165 is positioned to matingly engage the exterior surface of the top of the container (e.g. flange) when the stack flap 160 is in the second position. These position retention features 163, 165 are shaped to correspond with the peak and valley contour of the container and serves to distribute the load carried by the stack flap 160 through the container sidewall, when a second container is stacked on the stack flap. Accordingly, the stack flap 160 is maintains a generally horizontal position when in the second position.

The stack flap 160 can also include ribs or a textured surface to increase the frictional forces and further inhibit relative movement of the stacked containers. The textured surface can have a uniform pattern, or a random pattern, or can be a separate material applied to the stack flap 160. The stack flap 160 is integrally formed with the container and has sufficient strength and rigidity to remain permanently attached to the top edge of the container.

Figure 13:
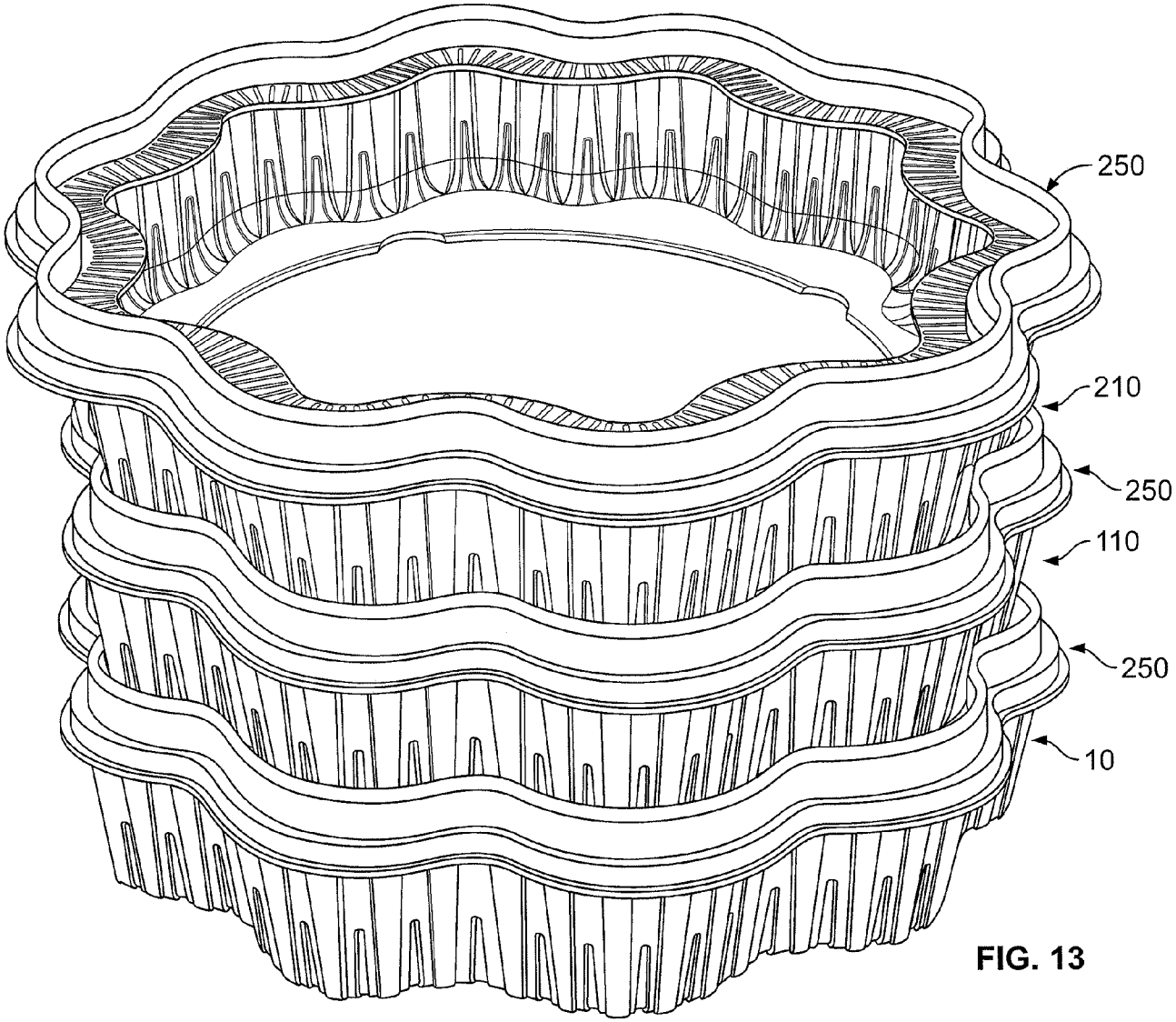
FIG. 13 is a perspective view of a stack of containers and plurality of stack rings in accordance with the disclosed subject matter.

As an alternative to the stack flaps 160, and in accordance with another aspect of the disclosed subject matter, a stack ring can be employed in the assembly of a plurality of stacked containers. For example, and as shown in FIGS. 12-16B, a stack ring 250 is positioned on the top (e.g. flange) of a first container 10 and configured to receive a second container 110 in a stacked relationship, as shown in FIG. 13. Additionally, or alternatively, the container and stack ring can be formed with alternative configurations and/or geometries. For example, the exemplary container and stack ring depicted in FIGS. 17-20 can be formed with a generally arcuate or scallop shape having less pronounced radii of curvature as compared to the undulating pattern depicted in FIGS. 12-16B. Further, it is to be understood that individual features of the stack ring depicted in FIGS. 12-16B can be included or combined with the features stack ring embodiment of FIGS. 17-20.

The containers to be used in forming the containers of the disclosed subject matter can be formed using conventional thermoforming (e.g., by pressure, vacuum, or the combination thereof), injection-molding processes, rotational molding, or other suitable techniques. The containers can be opaque or a variety of colors or color combinations. Likewise, the stack ring can be formed via the same processes as the container. Alternatively, the stack ring can be formed from a different process than the container, if so desired. As discussed above, the container can be formed from a variety of suitable materials, including polymeric materials. The stack ring can be formed from similar materials as the container including polymeric or paperboard material. Alternatively, the stack ring can be formed from a different material from the container. For example, the stack ring can be made from polypropylene while the container can be made from talc-filled polypropylene material.

The stack ring is formed as a separate and discrete element from the container so as to be removably positioned on the top of a container. The use of a stack ring is advantageous since it allows for convenient and rapid stacking of containers without requiring the relative rotation of the containers as discussed above. Additionally, the stack ring can be configured to provide an interference or "snap fit" with the top of the container which provides increased strength and stability to the container sidewall. Particularly, a plurality of containers can be stacked upon each other such that the peaks and valleys of the first container are aligned with the peaks and valleys of the second container.

Figure 17:
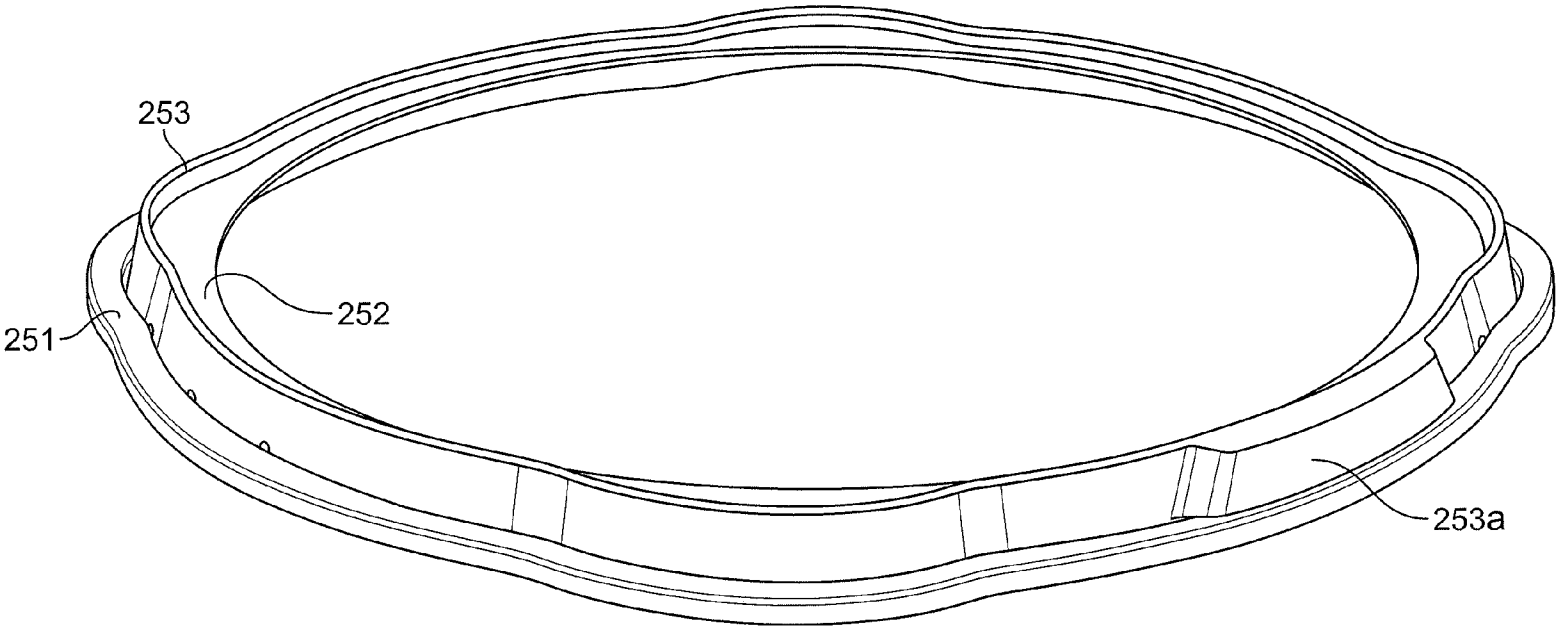
FIG. 17 is a perspective view of an alternative embodiment of the stack ring.
Figure 18:
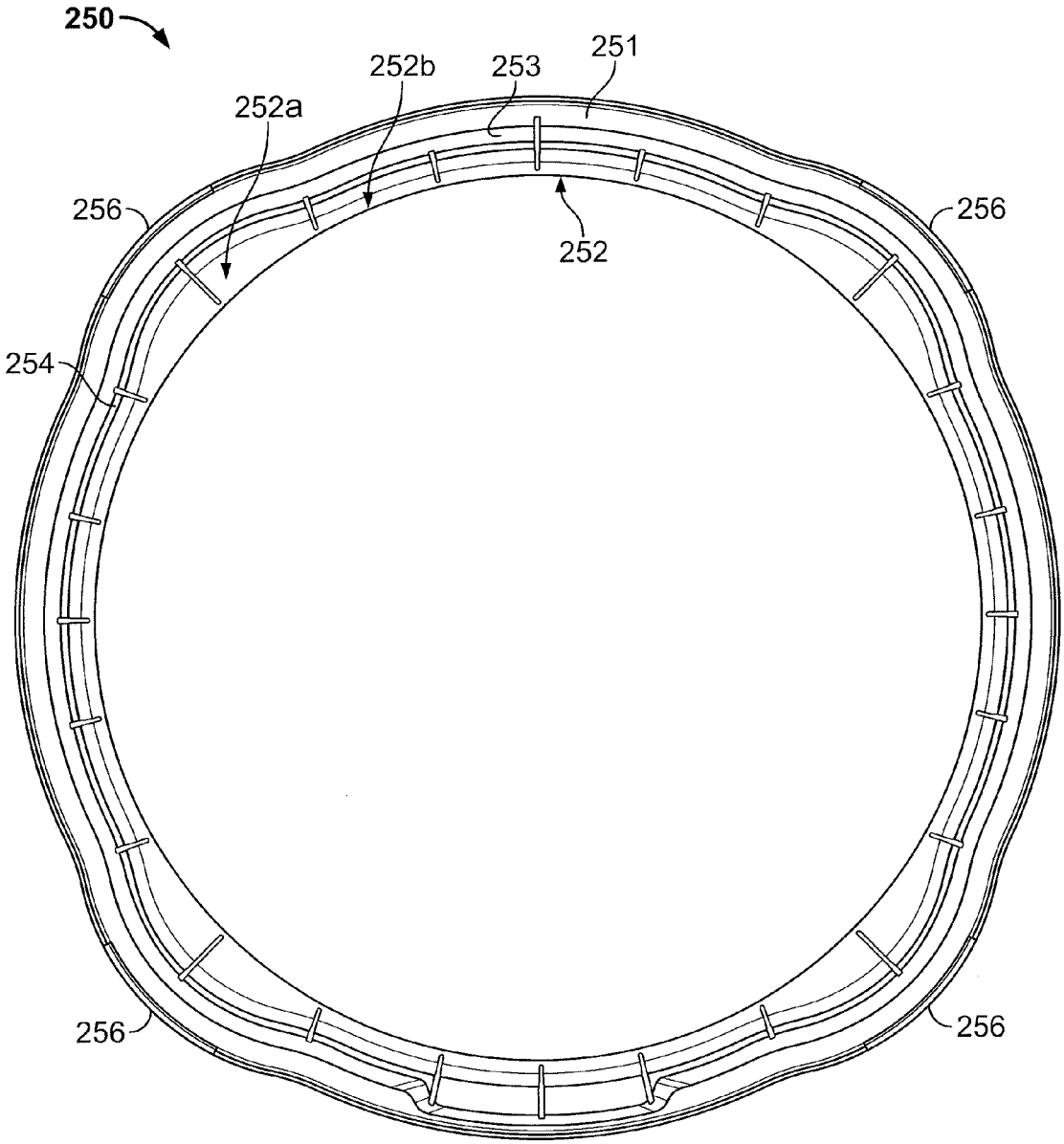
FIG. 18 is a bottom view of the stack ring of FIG. 17.

The stack ring 250 embodied herein has a generally open center portion and an outer perimeter that is complementary in contour with the perimeter of the container. The stack ring 250 has a flange portion 251, a lip portion 253, and an interior shelf 252 that extends inwardly from the lip portion 253. The interior shelf 252 is sized to extend inwardly a distance sufficient to engage and support the bottom of a second container stacked thereupon. In the embodiment depicted in FIGS. 12-15, the generally open center is configured with a shape that mirrors the sidewall profile, whereas the embodiment depicted in FIGS. 17-20 has the generally open center portion of the stack ring configured as a circular opening. As discussed above, the outer perimeter of the stack ring 250 is complementary in contour with the non-circular shape, e.g. peaks and valleys, of the sidewall profile. Accordingly, the interior shelf 252 can extend inwardly a non-uniform distance from the lip portion 253, as shown in FIG. 18. For example, the sidewall 230 and stack ring 250 can be formed with an undulating pattern of peaks and valleys having differing radii of curvature such that interior shelf portions 252*a* extend a greater distance than portions 252*b*.

Lip portion 253 of the stack ring can be configured as a vertical wall which extends from the flange 251 and protrudes above the shelf 251. As shown in FIG. 17, the flange 251 and interior shelf 252 can be disposed at different locations or heights on the vertical lip portion 253 such that the flange 251 and shelf 252 do not lie in the same plane. This offset or spaced relationship between the flange 251 and shelf 252 can be beneficial when a second container is positioned on the stack ring 250 in that the bottom of the second container can be received on the shelf 252, yet remain elevated above the top of the first container in order to facilitate venting and avoid undesired contact with the food product disposed in the underlying first container.

Figure 16A:
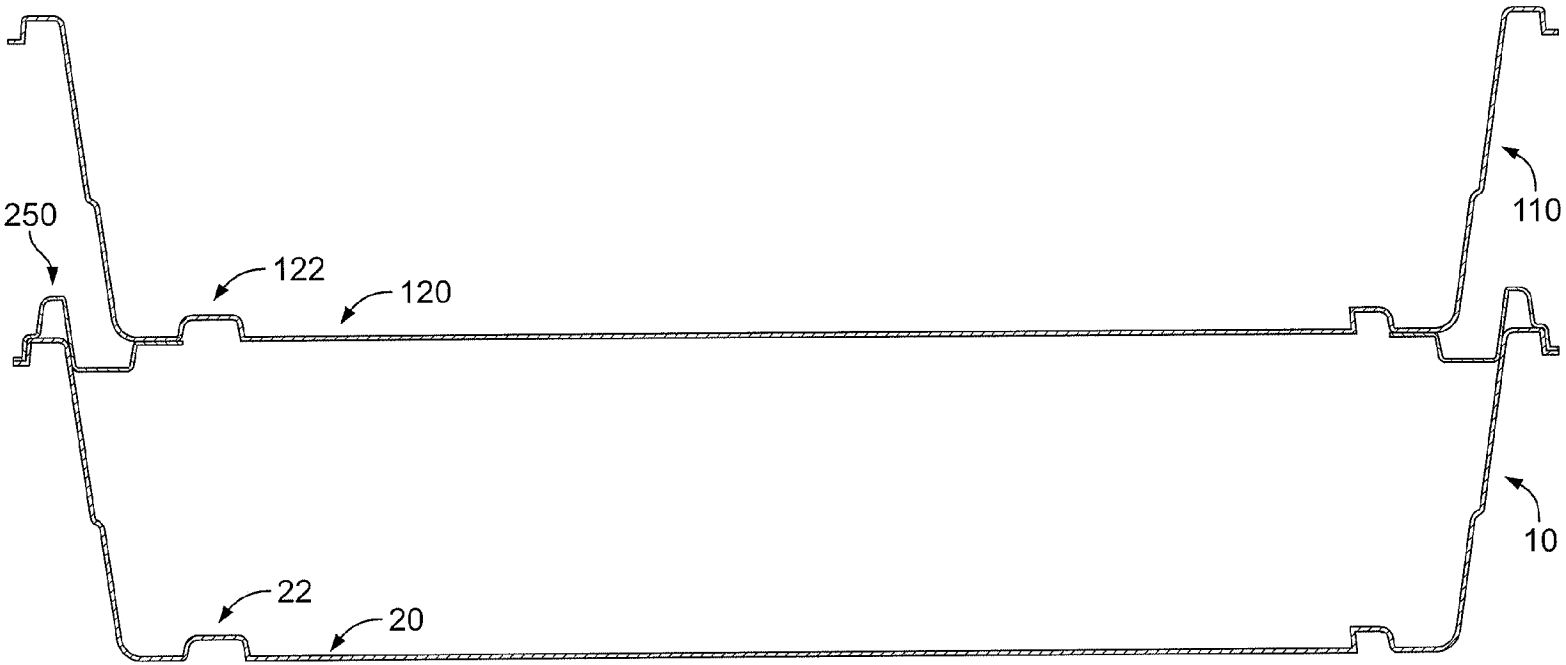
FIG. 16A is a cross sectional view of the container and stack ring across line A-A in FIG. 15.
Figure 16B:
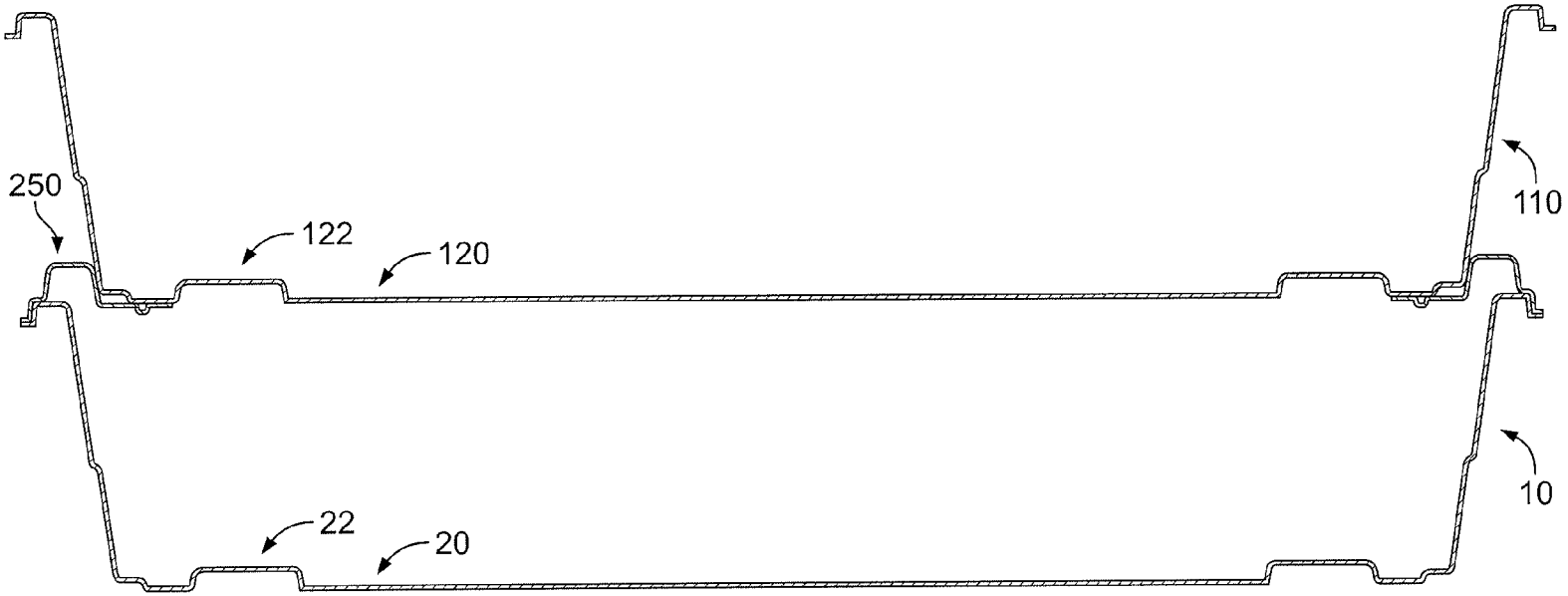
FIG. 16B is a cross sectional view of the container and stack ring across line B-B in FIG. 15.

Additionally, lip portion 253 can extend above the shelf 252 so as to contact a portion of the sidewall of the second container, as shown in FIG. 16B. This contact allows for mechanical engagement which prevents undesired shifting of the second container. Further, the lip portion 251 can extend a vertical distance below the stack ring flange 251 to form a reinforcing rib 254 which extends around at least a portion of the stack ring perimeter. This reinforcing rib can be configured to engage or abut the interior surface of the container sidewall when the stack ring is attached to a container.

In some embodiments, as shown in FIGS. 17-20, the lip portion 253 can be formed with a protrustion 253*a* which extends over a portion of the perimeter of the stack ring. This protrusion is preferably formed with a substantially planar surface area which allows indicia such as labels, logos, trademarks, etc., to be imprinted directly onto the stack ring, or alternatively affixed to the stack ring via adhesives or the like.

Figure 19:
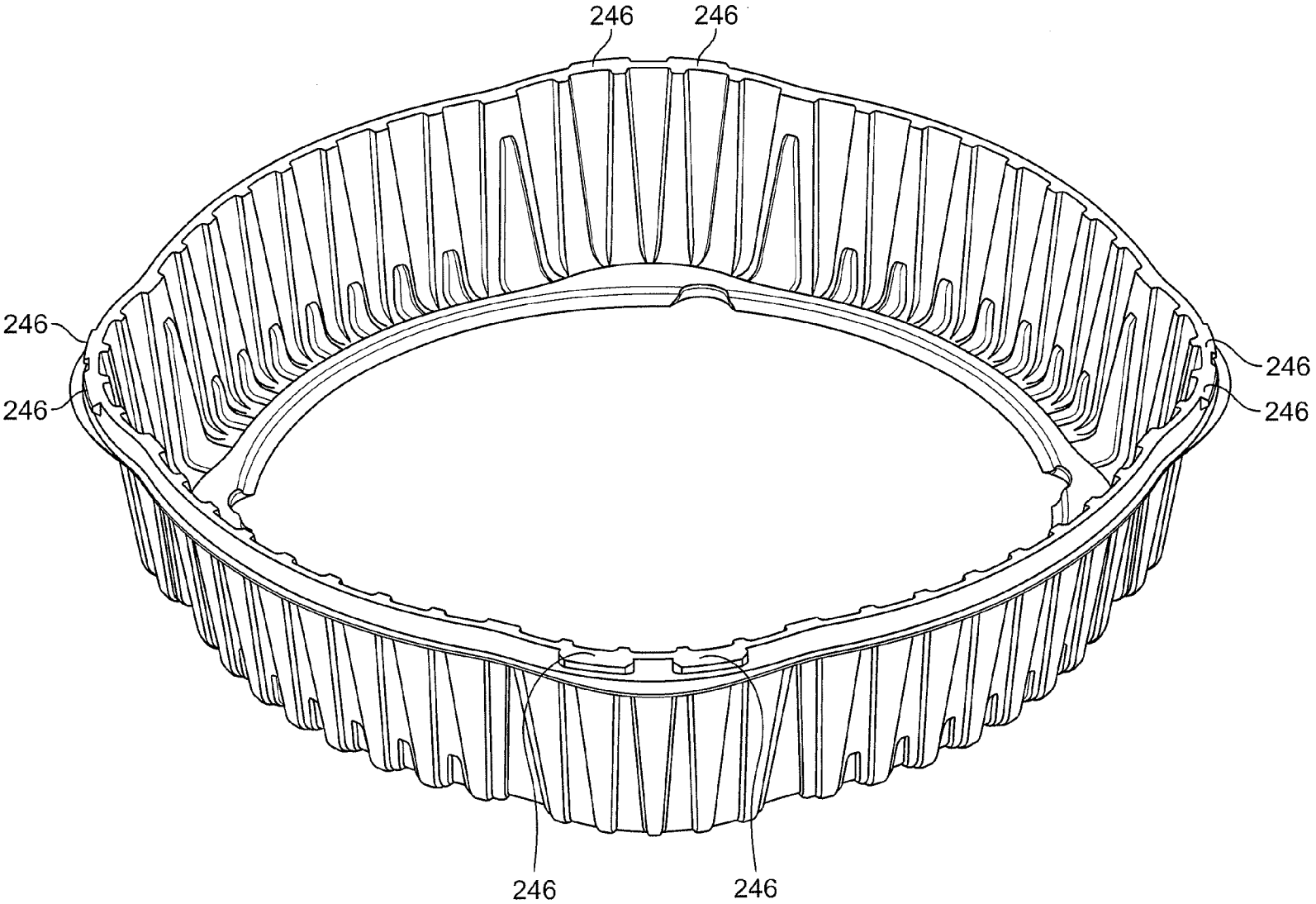
FIG. 19 is a perspective view of an alternative embodiment of the container.
Figure 20:
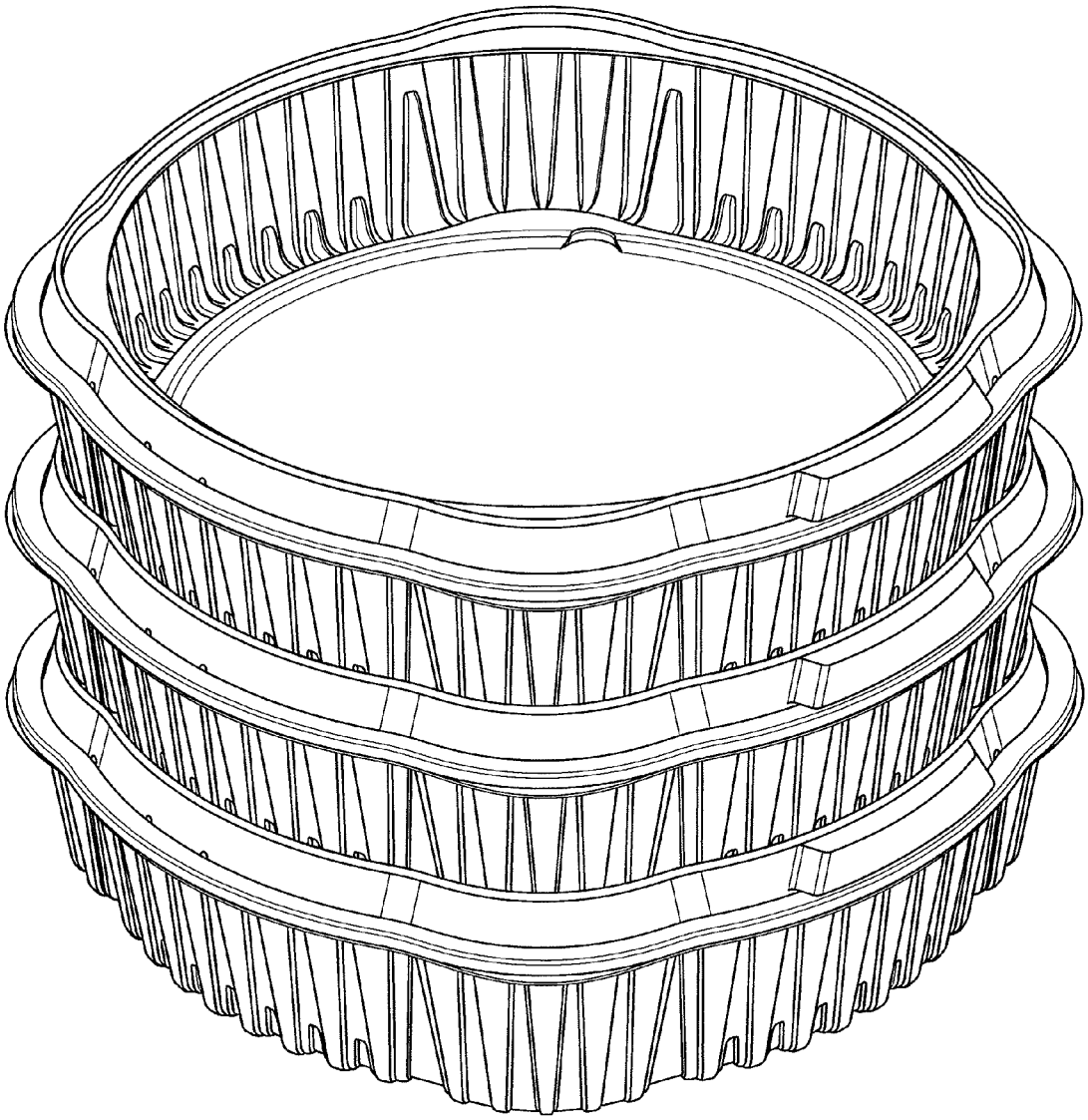
FIG. 20 is a perspective of a stack of containers and plurality of stack rings of FIGS. 17-18.

Further, the stack ring can be formed with undercuts which are configured to engage corresponding undercuts formed in the container to provide a more secure union between the container and stack ring. For example, the stack ring can have undercuts 256 located at select locations around the perimeter of the stack ring which coincide in location with undercuts 246 formed at select peaks of the container, as shown in FIGS. 18-19. The undercuts 246, 256 are configured to matingly engage and securely retain the stack ring on the container when assembled.

Figure 14:
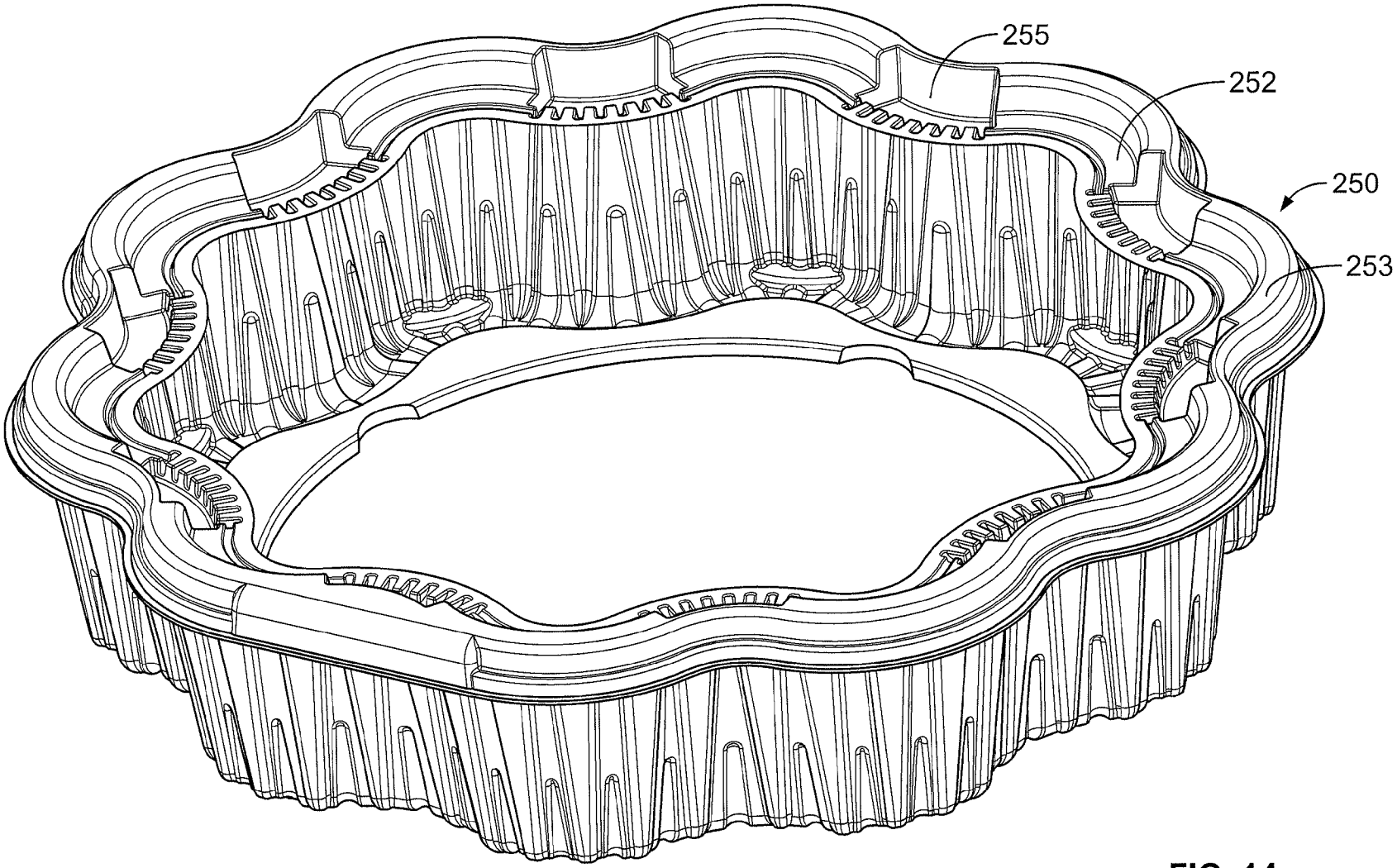
FIG. 14 is a perspective view of a container and a stack ring assembly.
Figure 15:
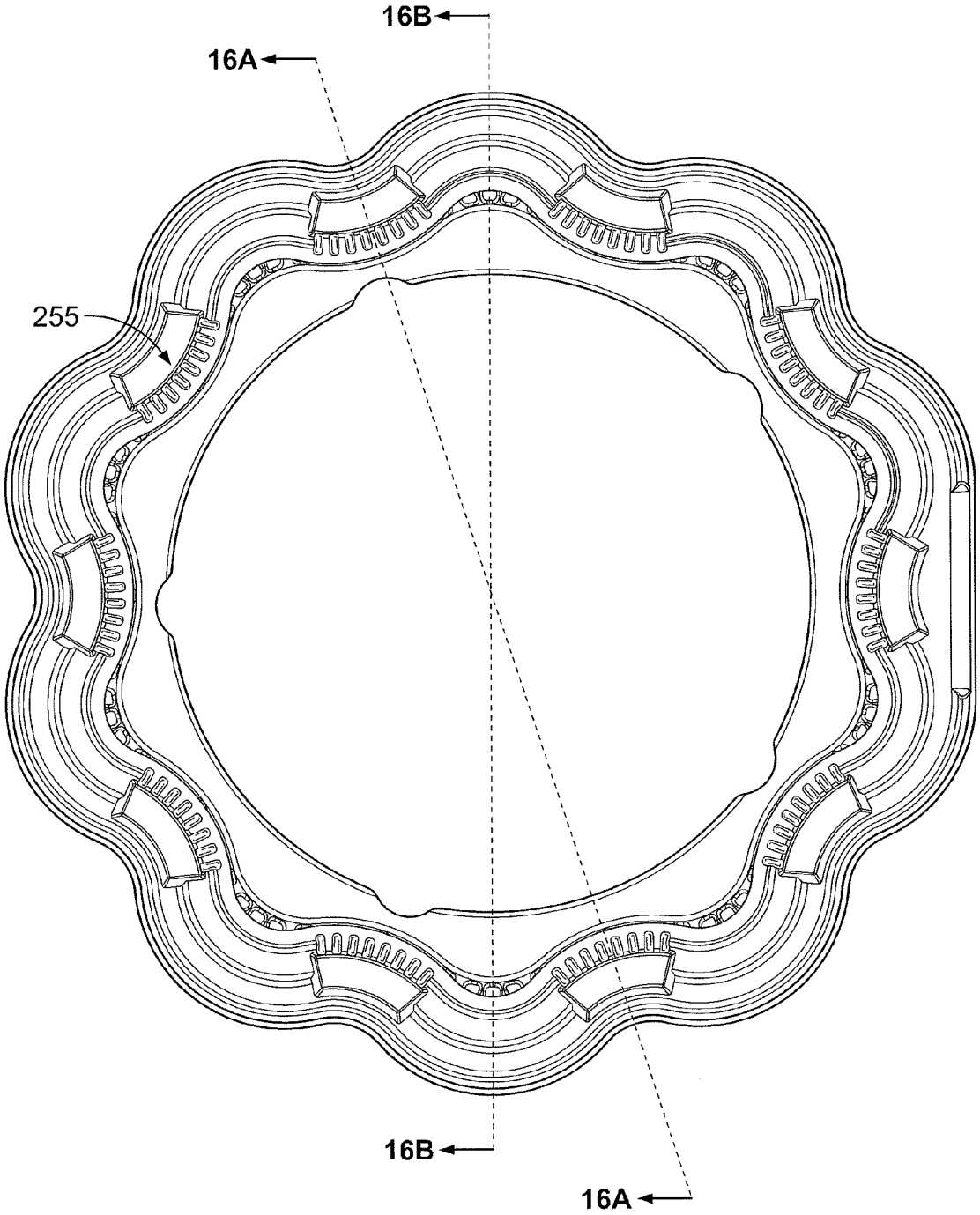
FIG. 15 is a plan view of a container and a stack ring assembly.

If desired, a stacking feature 255 can be formed in the interior shelf 252 as shown in FIGS. 14-15A, to further ensure alignment and prevent rotation or slippage during transport. A stacking feature 255 can be formed at each valley 233 of the stack ring 250, or at select locations, as so desired. It is therefore contemplated that the stack ring 250, having a stacking feature 255 formed therein, can be employed in combination with a container having a stacking feature 225 formed at the bottom of the container as described above with reference to FIGS. 1-8. For example, the stacking feature 255 of the stack ring 250 can be located in a peak and formed with an arcuate shape corresponding to the area between adjacent stacking features 225 along the bottom edge of a second container, as described above. In this manner, the stacking feature 225 on the bottom of one container will mate with the stacking feature 255 of the stack ring 250 to form a more secure engagement therebetween Alternatively, the stacking feature 255 on a stack ring 50 and the stacking feature 25 at the bottom edge of the sidewall can be located in the valley and have corresponding shapes for mating relationship therebetween.

Accordingly, when a plurality of containers are arranged in the stacked configuration, the bottom 220 (which can include stacking feature 225) of a second container 110 matingly engages the interior shelf 252 (which can include stacking feature 255) of the stack ring such that the bottom 220 of the second container is generally positioned within the same plane as the top (e.g. flange) of the first container, as shown in FIGS. 16A-B. The interior shelf 252 can also include ribs or a textured surface to increase the frictional forces and further inhibit relative movement of the stacked containers. The textured surfaces can have a uniform pattern, or they can be random, or can be a separate material applied to the interior shelf 252. As discussed above, the stack ring 250 is preferably of generally the same size and shape as the corresponding top (e.g. flange 240) of the container in order to inhibit or prevent lateral or rotational movement of the containers relative to each other. Additionally, the container can be provided with a film overwrap to protect the food contents from contamination. Preferrably, such a film overwrap would be located beneath the stack ring 250 and have sufficient flexibility such as to not obstruct the mating of a second container with the stack ring 250 positioned on a first container.

Although the containers used in the illustrated embodiments are pie containers, it is also contemplated that other containers can be formed. For example, containers can be formed, but are not limited to, plates, bowls, platters, tubs, single-serve and family-size containers or ovenware, and combinations thereof. Accordingly, it will be recognized by one of ordinary skill in the art that other containers, such as those discussed above, can be formed.

The height and shape of the container can vary from that shown without departing from the scope of the disclosed subject matter. For example, the containers of the illustrated embodiments are depicted as being generally circular. It is contemplated that the containers used herein can be other shapes such as square, hexagonal, octagonal, other polygonal shapes, or oval.

The containers of the disclosed subject matter are typically used with respect to food, but can be used in other applications. Also, the food containers disclosed herein can be used for serving, storing, preparing, and/or re-heating the food.

While the disclosed subject matter is described herein in terms of certain preferred embodiments, those skilled in the art will recognize that various modifications and improvements can be made to the disclosed subject matter without departing from the scope thereof. Moreover, although individual features of one embodiment of the disclosed subject matter can be discussed herein or shown in the drawings of the one embodiment and not in other embodiments, it should be apparent that individual features of one embodiment can be combined with one or more features of another embodiment or features from a plurality of embodiments.

In addition to the specific embodiments claimed below, the disclosed subject matter is also directed to other embodiments having any other possible combination of the dependent features claimed below and those disclosed above. As such, the particular features presented in the dependent claims and disclosed above can be combined with each other in other manners within the scope of the disclosed subject matter such that the disclosed subject matter should be recognized as also specifically directed to other embodiments having any other possible combinations. Thus, the foregoing description of specific embodiments of the disclosed subject matter has been presented for purposes of illustration and description. It is not intended to be exhaustive or to limit the disclosed subject matter to those embodiments disclosed.

It will be apparent to those skilled in the art that various modifications and variations can be made in the method and system of the disclosed subject matter without departing from the spirit or scope of the disclosed subject matter. Thus, it is intended that the disclosed subject matter include modifications and variations that are within the scope of the appended claims and their equivalents.

The invention claimed is:

1. A stack of containers comprising:

a first container and a second container, each of the first container and the second container being substantially similar in shape and including:

a bottom having a periphery, a side wall extending generally upward from the bottom about the periphery in an outwardly-extending continuously-undulating pattern of peaks and valleys to define an interior of the container, the side wall defining a top edge having the continuously-undulating pattern of peaks and valleys entirely about a perimeter of the top edge; and a stack ring disposed at the top edge of the first container, the stack ring having an open center and an interior shelf extending inwardly towards the open center;

wherein the bottom of the second container is disposed on the interior shelf of the stack ring.

2. The stack of containers of claim 1, wherein the stack ring has an outer perimeter that coincides with the perimeter of the top edge.

3. The stack of containers of claim 2, wherein the outer perimeter of the stack ring has the outwardly-extending continuously-undulating pattern of peaks about the outer perimeter.

4. The stack of containers of claim 1, wherein the stack ring includes a flange portion and a lip portion, wherein the lip portion is disposed between the interior shelf and the flange portion.

5. The stack of containers of claim 4, wherein the lip portion extends in a generally vertical direction, with the flange portion and interior shelf disposed at different locations on the lip portion.

6. The stack of containers of claim 1, wherein the stack ring and at least one container are formed with undercuts to engage each other.

7. The stack of containers of claim 1, wherein the stack ring includes a protrusion which extends around at least a portion of a perimeter of the stack ring.

8. The stack of containers of claim 1, wherein the stack ring includes a reinforcing rib.

9. The container system according to claim 1, wherein the bottom includes a food product centering feature.

10. The container system according to claim 1, wherein the continuously-undulating pattern of peaks and valleys permit venting of each of the first container and the second container of the stack.

11. The container system according to claim 10, wherein a valley of the second container is positioned above a peak of the first container to define gap between the first container and the second container to permit venting of each of the first container and the second container of the stack.

12. The stack of containers of claim 1, wherein each of the first container and the second container is symmetrical about a plurality of diameters in plan view.

13. The stack of containers of claim 1, wherein the stack ring is removable from the first container.

14. The stack of containers of claim 1, wherein the interior shelf defines the open center.

15. A container system, comprising:

a container including a bottom having a periphery, a side wall extending generally upward from the bottom about the periphery in an outwardly-extending continuously-undulating pattern to define an interior of the container, the side wall defining a top edge having the continuously-undulating pattern of peaks and valleys entirely about a perimeter of the top edge; and a stack ring disposable proximate the top edge of the side wall.

16. The container system according to claim 15, wherein the stack ring has an interior shelf extending inwardly to define an open center.

17. The container system according to claim 16, wherein the stack ring includes a flange portion and a lip portion, wherein the lip portion is disposed between the interior shelf and the flange portion.

18. The container system according to claim 17, wherein the lip portion extends in a generally vertical direction, with the flange portion and interior shelf disposed at different locations on the lip portion.

19. The container system according to claim 16, wherein the interior shelf extends toward a center of the container to engage and support a bottom of a second container substantially similar to the container.

20. The container system according to claim 16, wherein the interior shelf has a textured surface.

21. The container system according to claim 15, wherein the stack ring has an outer perimeter that coincides with the perimeter of the top edge.

22. The container system of claim 21, wherein the outer perimeter of the stack ring has the outwardly-extending continuously-undulating pattern of peaks and about the outer perimeter.

23. The container system according to claim 15, wherein the stack ring includes a protrusion which extends around at least a portion of a perimeter of the stack ring.

24. The container system according to claim 15, wherein the stack ring includes at least one reinforcing rib.

25. The container system according to claim 24, wherein the at least one reinforcing rib engages an interior surface of the side wall when the stack ring is disposed on the top edge of the side wall of the container.

26. The container system according to claim 15, wherein the continuously-undulating pattern of the side wall includes a continuously-alternating pattern of peaks and valleys.

27. The container system according to claim 15, wherein the bottom defines a generally circular periphery.

28. The container system according to claim 15, wherein the bottom defines a non-circular periphery.

29. The container system according to claim 15, wherein the bottom includes a plurality of apertures therethrough.

30. The container system according to claim 15, wherein the bottom includes a food product centering feature.

31. The container system according to claim 15, wherein the container is made of talc-filled polypropylene.

32. The container system according to claim 15, wherein the stack ring is made of at least one of talc-filled polypropylene or polypropylene.

33. The container system according to claim 15, wherein the stack ring and container are each formed with undercuts to engage with each other.

34. The container system according to claim 15, wherein the continuously-undulating pattern of peaks and valleys comprise an anti-rotation interlock feature.

35. The container system according to claim 15, wherein the continuously-undulating pattern of peaks and valleys permit venting of each of the first container and the second container of the stack.

36. The container system according to claim 35, wherein a valley of second container is positioned above a peak of the first container to define gap between the first container and the second container to permit venting of each of the first container and the second container of the stack.

37. The container system according to claim 15, wherein the continuously-undulating pattern of peaks and valleys comprise an anti-rotation interlock feature.

38. The stack of containers of claim 15, wherein each of the first container and the second container is symmetrical about a plurality of diameters in plan view.

39. The stack of containers of claim 15, wherein the stack ring is removable from the container.

* * * * *